US011215417B2

(12) United States Patent
Mather et al.

(10) Patent No.: US 11,215,417 B2
(45) Date of Patent: Jan. 4, 2022

(54) SAFETY MECHANISM FOR HAMMER-OPERATED FIREARMS

(71) Applicant: Sturm, Ruger & Comany, Inc., Southport, CT (US)

(72) Inventors: Jonathan Philip Mather, Grafton, NH (US); Andrew James Beland, Gilmanton, NH (US); Geoffrey William Smith, Wilmot, NH (US); Kenneth Bruce McLoud, Goshen, NH (US); Eric Mitchell Callum, Unity, NH (US); Jonathan Barrett, Georges Mills, NH (US)

(73) Assignee: STURM, RUGER & COMPANY, INC.

( * ) Notice: Subject to any disclaimer, the term of this patent is extended or adjusted under 35 U.S.C. 154(b) by 0 days.

(21) Appl. No.: 16/942,203

(22) Filed: Jul. 29, 2020

(65) Prior Publication Data

US 2021/0033364 A1 Feb. 4, 2021

Related U.S. Application Data

(60) Provisional application No. 62/879,725, filed on Jul. 29, 2019.

(51) Int. Cl.
*F41A 17/76* (2006.01)
*F41C 3/14* (2006.01)

(52) U.S. Cl.
CPC ..... *F41A 17/76* (2013.01); *F41C 3/14* (2013.01)

(58) Field of Classification Search
CPC ..... F41A 17/72; F41A 17/74; F41A 17/76; F41C 3/14
(Continued)

(56) References Cited

U.S. PATENT DOCUMENTS 3,142,924 A 8/1964 Ruger et al.
3,626,622 A 12/1971 Uberti
(Continued)

FOREIGN PATENT DOCUMENTS

| | | |
|---|---|---|
| CN | 205878999 | 1/2017 |
| CN | 105571387 | 4/2017 |
| EP | 2160562 | 8/2012 |

OTHER PUBLICATIONS

International Search Report and Written Opinion issued in International Application No. PCT/US20/44042 dated Oct. 14, 2020.
(Continued)

*Primary Examiner* — Bret Hayes
(74) *Attorney, Agent, or Firm* — The Belles Group, P.C.

(57) ABSTRACT

A firearm with safety mechanism in one embodiment includes a barrel supported by a housing, at least one cartridge-receiving chamber in communication with a bore of the barrel, and a rotatable hammer. The safety mechanism includes a biased safety component, which may be a blocking pin in one embodiment, mounted to and rotatable with the hammer. When the firearm is exposed to an abnormal impact force caused by bumping or dropping the firearm, the safety component changes position and interacts with a blocking feature on the hammer pivot pin to stop or delay the motion of the hammer in a manner which prevents discharging the firearm. The blocking feature may be a notch in one embodiment. Rotating the hammer between rearward cocked and forward firing positions alternatingly aligns or misaligns the blocking pin with the notch, respectively.

38 Claims, 21 Drawing Sheets

(58) Field of Classification Search
USPC ..... 42/66, 70.01, 70.08
See application file for complete search history.

(56) References Cited

U.S. PATENT DOCUMENTS

| | | | | |
|---|---|---|---|---|
| 3,626,623 | A | 12/1971 | Uberti | |
| 3,748,771 | A | 7/1973 | Piscetta | |
| 3,838,533 | A | 10/1974 | Ruger | |
| 4,208,947 | A | 6/1980 | Hillberg | |
| 4,680,884 | A | 7/1987 | Smith, Jr. et al. | |
| 4,962,606 | A | 10/1990 | Pozzi | |
| 5,208,406 | A | 5/1993 | Badali | |
| 5,267,407 | A * | 12/1993 | Bornancini | F41A 17/30 42/70.08 |
| 5,548,914 | A | 8/1996 | Anderson | |
| 5,625,970 | A | 5/1997 | Pantuso et al. | |
| 5,635,663 | A * | 6/1997 | Krieger | F41A 11/02 42/69.03 |
| 6,269,576 | B1 | 8/2001 | Williams | |
| 6,289,619 | B1 * | 9/2001 | Fuchs | F41A 19/14 42/69.03 |
| 6,405,471 | B1 | 6/2002 | Mauch | |
| 6,438,886 | B1 | 8/2002 | Neumann | |
| 6,543,170 | B2 | 4/2003 | Beretta | |
| 6,865,839 | B2 | 3/2005 | Bantle et al. | |
| 6,889,459 | B1 | 5/2005 | Salvitti | |
| 6,928,763 | B2 | 8/2005 | Zajk et al. | |
| 7,234,261 | B2 | 6/2007 | McGarry | |
| 7,263,796 | B2 * | 9/2007 | Kellermann | F41A 19/47 42/69.03 |
| 7,832,135 | B1 | 11/2010 | Salvitti | |
| 8,443,537 | B2 | 5/2013 | Curry | |
| 8,464,455 | B2 | 6/2013 | Kallio | |
| 8,677,666 | B2 | 3/2014 | Pichler | |
| 9,810,506 | B2 | 11/2017 | Curry | |
| 10,018,439 | B2 | 7/2018 | Bailey | |
| 2002/0148152 | A1 | 10/2002 | Curry et al. | |
| 2004/0118029 | A1 | 6/2004 | Pagnoncelli | |

OTHER PUBLICATIONS

Instruction Manual for Ruger GP100® Double-Action Revolver, 2018.

* cited by examiner

SAFETY MECHANISM FOR HAMMER-OPERATED FIREARMS

CROSS-REFERENCE TO RELATED APPLICATIONS

The present application claims priority to U.S. Provisional Patent Application Ser. No. 62/879,725 filed Jul. 29, 2019, which is incorporated herein by reference in its entirety.

BACKGROUND

The present invention generally relates to firearms, and more particularly to hammer-operated firearms including revolvers in one embodiment with automatically actuated safety mechanisms.

Hammer-operated firearms such as revolvers in one form typically include a cylinder frame which rotatably supports a revolving cylinder having a plurality of chambers for holding cartridges and a grip frame that provides a structure for mounting and supporting a hand grip attached thereto at the rear of the revolver. The barrel of the revolver is also mounted to the front of or forms part of the cylinder frame.

Rotating hammers as used in revolver and many other types of firearms to transfer stored energy into a firing pin and ignite a primer in a cartridge. In many configurations, the hammer is held in a rearward cocked position by a trigger mechanism, and released when the trigger is pulled or moved by the shooter. It is undesirable to have the hammer release when the firearm is dropped or impacted, and there are numerous methods and mechanisms used to prevent firearms from firing during these situations. Some firearms are more sensitive to releasing the hammer when impacted in particular directions or dropped in particular orientations.

Accordingly, an improved safety mechanism for a revolver is desired.

SUMMARY

A firearm according to the present disclosure includes a safety mechanism configured and operable to address the foregoing firearm drop and impact situations. The firearm may be a revolver herein in one non-limiting embodiment for illustrative purposes of the safety mechanism; however, the safety mechanism is broadly adaptable to many other types of hammer-operated firearms including for example without limitation pistols, rifles, and shotguns. The term firearm as used herein therefore should be broadly construed.

The firearm includes a housing which may be a cylinder frame in one embodiment which carriers a rotatable cylinder. A rotatable hammer is mounted about a transverse pivot pin in the housing at the rear of the cylinder. In general, the safety mechanism in one embodiment comprises a biased blocking member such as a cylindrical blocking pin in one non-limiting embodiment mounted within a recess or bore in the hammer. The blocking pin is selectively engageable with a blocking feature on the hammer pivot pin, which may be a blocking notch in one non-limiting embodiment. The hammer pivot pin may be non-rotating relative to the housing in one implementation. When exposed to an abnormal force such as via dropping the firearm when the hammer is in a cocked position, the blocking pin moves into the blocking notch formed in the non-rotating hammer pivot pin to stop or delay the motion of the hammer. The hammer blocking pin thus operably interacts directly with the non-rotating hammer pivot pin. Advantageously, the hammer blocking safety mechanism is automatically deployed without manual operation or intervention by the user.

According to one aspect, a firearm with safety mechanism comprises: a housing; a spring-biased hammer rotatably supported by a transverse hammer pivot pin fixed in position relative to the housing, the hammer movable between a rearward cocked position and a forward firing position; a trigger operable to release the hammer from the cocked position to discharge the firearm; a blocking feature formed on the hammer pivot pin; and a hammer blocking member movably mounted to the hammer and selectively engageable with the blocking feature; wherein rotating the hammer from the firing position to the cocked position aligns the blocking member with the blocking feature of the hammer pivot pin such that the blocking member is movable to engage the blocking feature. In one embodiment, the blocking feature is a notch and the blocking member is a cylindrical pin.

According to another aspect, a revolver with safety mechanism comprises: a cylinder frame supporting a rotatable cylinder defining a plurality of cartridge-receiving chambers; a spring-biased hammer rotatably supported by a stationary hammer pivot pin arranged in the frame, the hammer movable between a rearward cocked position and a forward firing position; a trigger engageable with the hammer and operable to release the hammer therefrom; a blocking notch formed on the hammer pivot pin; and a hammer blocking pin movably mounted to the hammer and selectively engageable with the blocking feature; wherein rotating the hammer from the firing position to the cocked position aligns the blocking pin with the blocking notch of the hammer pivot pin such that the blocking pin is slideably engageable with the blocking notch.

In another aspect, a method for blocking a firing mechanism of a firearm comprises: providing the firearm including a hammer mounted about a hammer pivot pin and rotatable between a rearward cocked position and a forward firing position, a trigger operable to release the hammer, and a movable blocking member; positioning the hammer in the firing position, the blocking member being misaligned with a blocking feature on the hammer pivot pin; rotating the hammer to the cocked position; aligning the blocking member with the blocking feature on the hammer pivot pin; impacting the firearm on a surface; automatically moving the blocking member from a retracted position disengaged from the blocking feature of the hammer pivot pin to a projected position engaged with the blocking feature; and arresting rotation of the hammer to prevent discharging the firearm via the blocking member engagement with the blocking feature.

BRIEF DESCRIPTION OF THE DRAWINGS

The features of the exemplary embodiments will be described with reference to the following drawings where like elements are labeled similarly, and in which.

Figure 1:
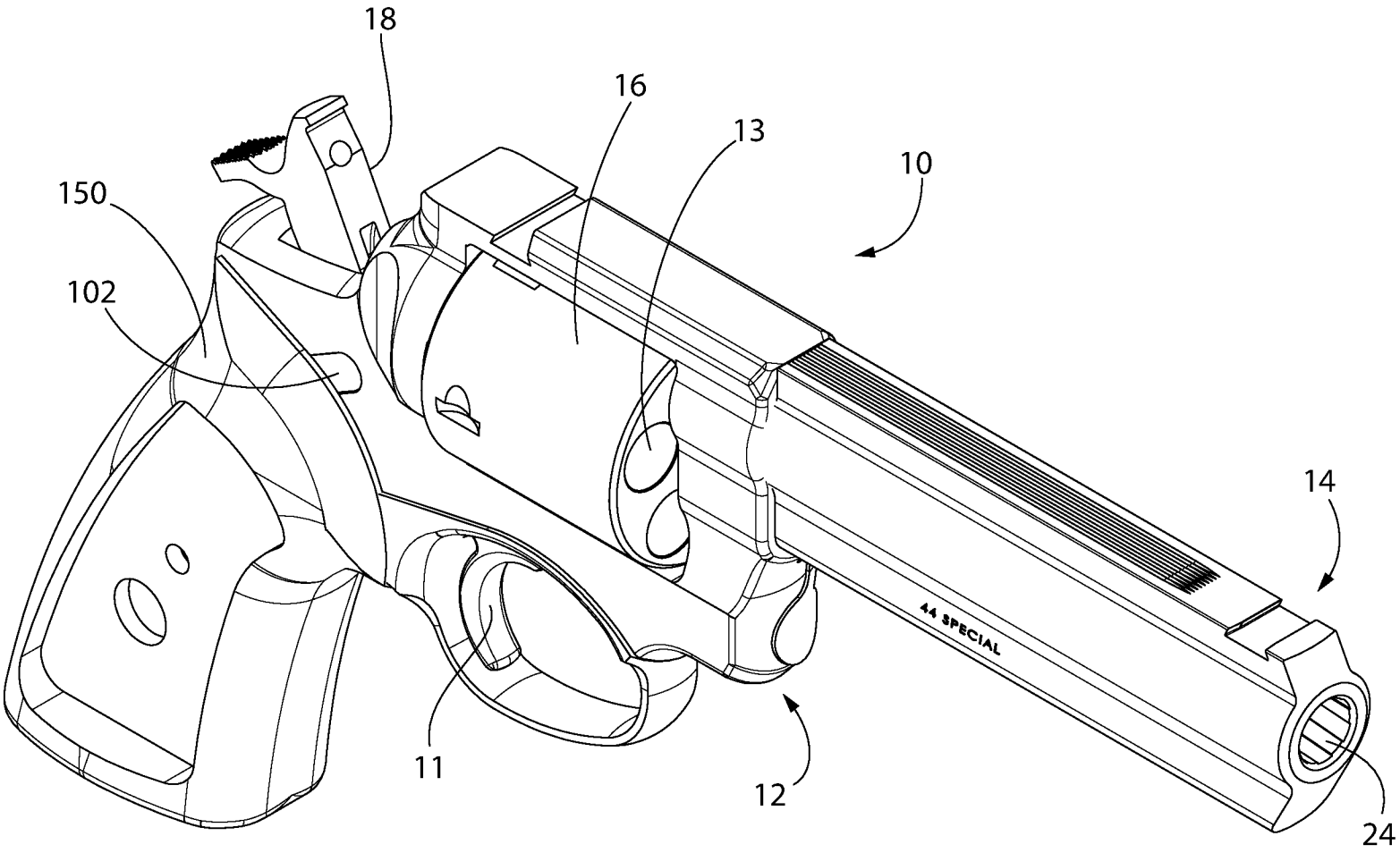
FIG. 1 is a right side perspective view of one embodiment of a firearm with safety mechanism according to the present disclosure.
Figure 2:
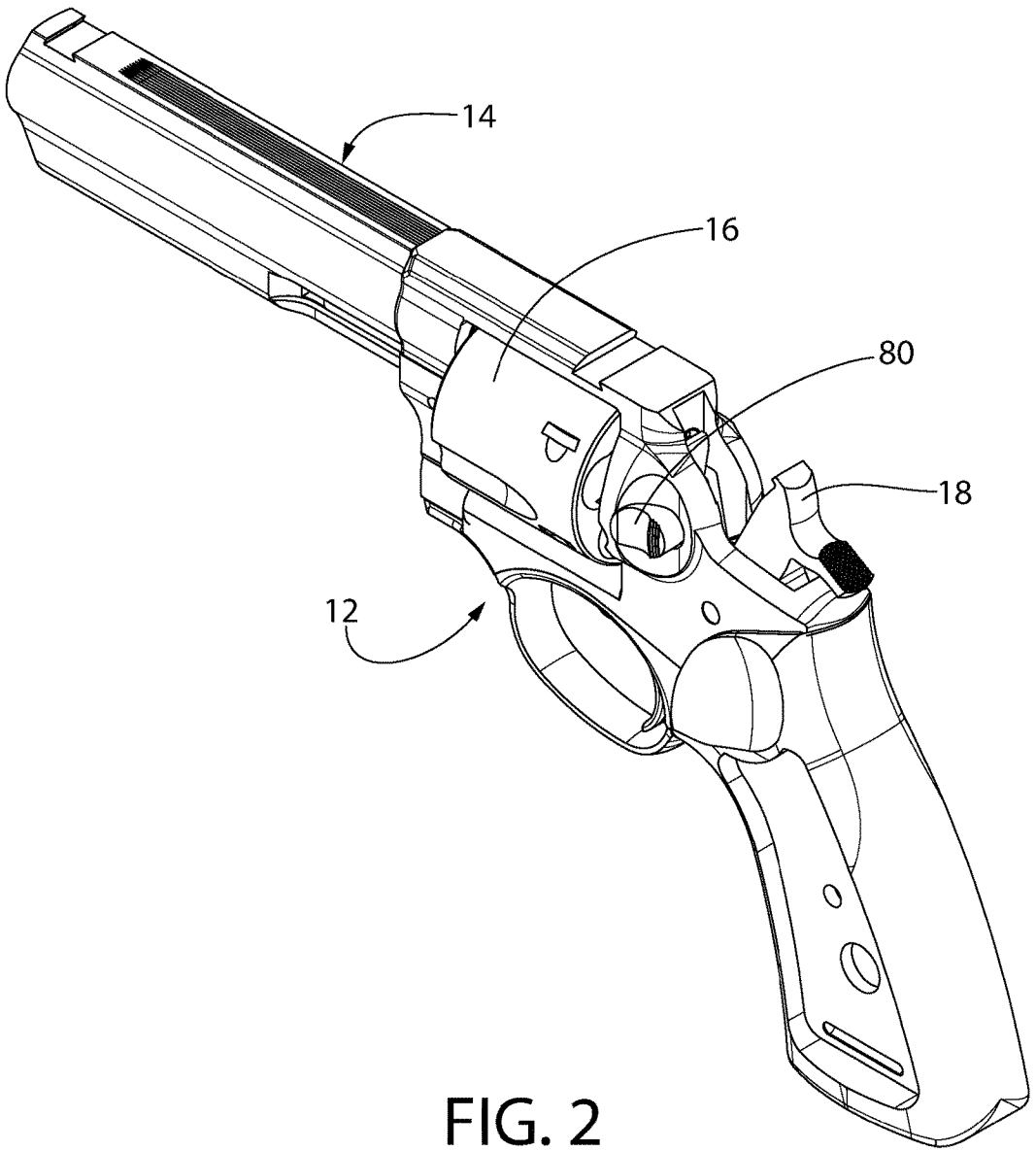
FIG. 2 is a left side perspective view thereof.
Figure 3:
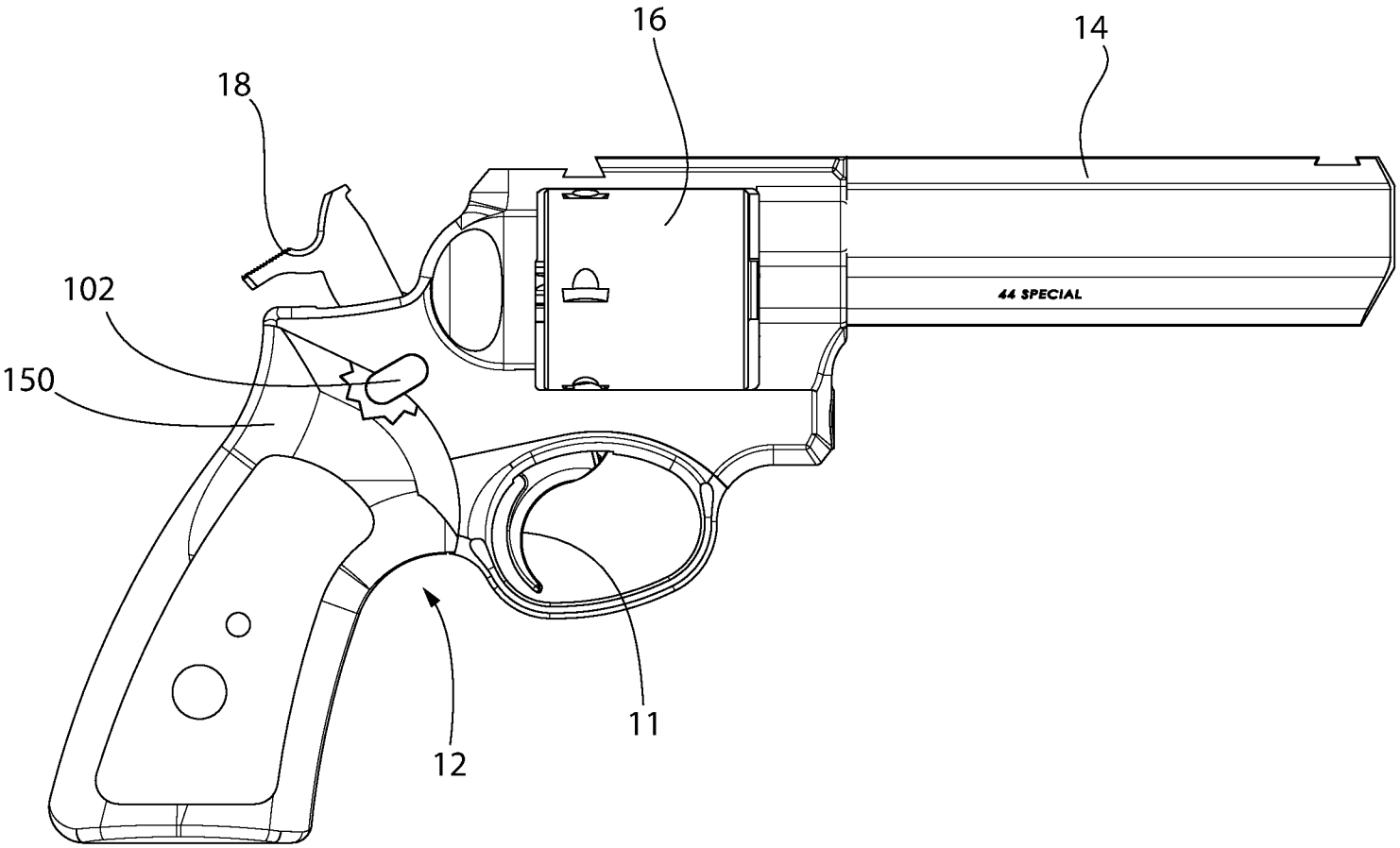
FIG. 3 is a right side elevation view thereof.
Figure 4:
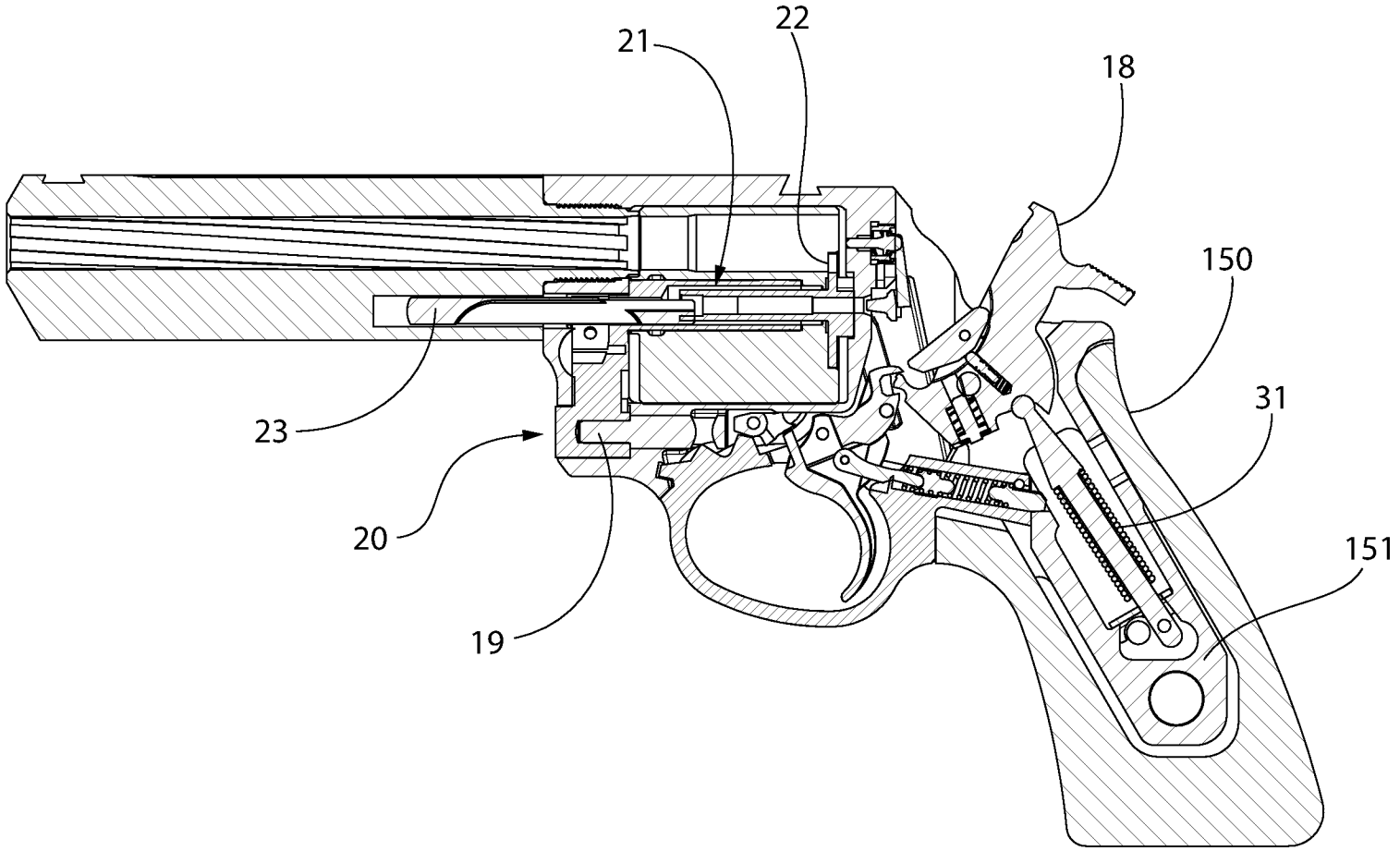
FIG. 4 is a left side cross-sectional view thereof.

All figures are schematic and not necessary to scale. Features numbered in some figures but not in others are the same features unless expressly noted otherwise.

DETAILED DESCRIPTION OF THE EMBODIMENTS

The features and benefits of the invention are illustrated and described herein by reference to exemplary ("example") embodiments. This description of exemplary embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected" and "interconnected," refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplary embodiments. Accordingly, the invention expressly should not be limited to such exemplary embodiments illustrating some possible non-limiting combination of features that may exist alone or in other combinations of features; the scope of the invention being defined by the claims appended hereto.

FIGS. 1-20 depict a firearm in the form of a revolver 10 and components thereof including a hammer-blocking safety mechanism according to the present disclosure. The revolver may be a double-action revolver in one embodiment; however, the revolver in other embodiments may be a single action revolver. Either design may be used and is not limiting of the present invention. In other embodiments, the firearm may be a pistol with fixed receiver or a reciprocating receiver (i.e. slide), or a long gun such as a rifle or shotgun. The term Revolver 10 includes a barrel 14 supported by a housing 12. Depending on the type firearm, the housing may be any of the following including but not limited to a frame or chassis of any type firearm, a cylinder frame of a revolver, a fixed receiver of a pistol, rifle, or shotgun, a reciprocating receiver of a pistol (aka "slide"), a trigger or firing control housing which supports at least some firing components of the firing mechanism and is attachable to a frame or chassis, or any other type of housing used in a firearm. The term "housing" therefore should be broadly construed in a non-limiting manner to encompass any of the foregoing examples.

The housing 12 of the present revolver 10, which may alternatively be referred to as a cylinder frame or alternatively receiver in the art, rotatably carries a cylinder 16 defining a plurality of chambers 13 formed inside therein for holding ammunition cartridges. In various embodiments, housing 12 preferably be may be made of metal (e.g. aluminum, titanium, steel, etc.), suitable strong plastic, or combinations thereof.

Cylinder 16 may be supported by a conventional swing-out cylinder crane mechanism 20 in one embodiment including an upper support tube 21 received through the hub of the cylinder and a lower retaining pin 19 removably received through an aperture of the crane and housing 12. Cylinder crane 20 is used to pivot cylinder 16 outwards from cylinder housing 12 from a ready-to-fire position wherein the cylinder is positioned in the housing and one chamber 13 of the cylinder may be aligned with barrel 14, to a lateral loading position for loading cartridges into chambers 13 wherein the cylinder is laterally displaced from the housing to expose the chambers. Crane latch 80 operates to release and swing cylinder 16 outwards for spent casing ejection and reloading. In other possible embodiments, the revolver however may have a tilting break-open type cartridge loading mechanism with a pivoting cylinder and barrel assembly which is also well known in the art rather than a swing out cylinder. Either design may be used and is not limiting of the present invention.

Barrel 14 extends axially forward from housing 12 of the revolver 10 and defines an internal bore 24 for guiding the projectile (e.g. slug or bullet) towards the front muzzle end of the barrel. The bore of the barrel 14 which defines the projectile passageway defines a longitudinal axis LA of the firearm. The barrel may be a two-pieced shrouded barrel design in some embodiments having an external shroud and internal barrel insert, or a single-piece unshrouded barrel. Either design may be used and is not limiting of the present invention.

Revolver 10 further includes a conventional spring-biased ejector 22 for ejecting spent cartridge casings from the revolver. Ejector 22 is disposed at the rear of cylinder 16 and is configured to operably engage the rim of the spent cartridge casing in the cylinder after firing all rounds. An ejector rod 23 carried by the cylinder is operably coupled to ejector 22 via a tube 22*a* of the ejector which through the hub of the cylinder 16. An ejector spring (not shown) biases ejector rod 23 forward and may be depressed by a user to eject spent cartridge casings from the revolver cylinder 16 in a conventional manner.

Revolver 10 in an exemplary embodiment includes a firing control mechanism supported by the housing 12 and operable to discharge the firearm. The firing control mechanism generally includes the following firing control components: trigger 11, hammer 18, cylinder lock 32, hammer lever or dog 34, pawl 35, and mainspring assembly including mainspring 31. In one embodiment, mainspring assembly includes mainspring strut 64 having an upper end engaging hammer 18 and a lower end braced against the grip portion of housing 12. Mainspring 31 biased the hammer towards the forward firing position. Pawl 35 may be pivotably mounted to trigger 11 via pin 35*a* and is arranged to engage the cylinder ratchet 81 which rotates the cylinder to the next position each time the trigger is pulled. Pulling trigger 11 rearward raises the pawl which engages and rotates the cylinder to align an active one of the chambers 13 with the firing pin and barrel bore 24. In conventional manner, the cylinder 16 is locked in the aligned position via cylinder lock 32 engaging one of the plurality of circumferentially spaced locking notches 82 formed on the exterior of the cylinder (see, e.g. FIGS. 8 and 9). Cylinder lock 32 is mounted about pinned connection 39 to revolver housing 12 and is actuated automatically by trigger 11 when pulled.

Hammer dog 34 is essentially a spring-biased lever that is pivotably mounted to hammer 18 about a pinned connection 52 and is operably positioned between trigger 11 and hammer 18. The lower end of hammer dog 34 is biased forward toward trigger 11 by a spring-plunger assembly including spring 54 to engage rear operating extension arm 51 of the trigger. Hammer dog 34 is engaged by and rotated upwards by trigger 11 in response to a trigger pull to partially cock the hammer when firing the revolver in double action mode. Specifically, top cam surface 11*a* formed on trigger 11 engages the hammer dog during the initial phase of the trigger pull, as further described herein. Cam surface 11*a* may be rounded to smoothly engage and operate the hammer dog 34.

Referring to FIGS. 8-11, hammer 18 is pivotably mounted to housing 12 rearward of the cylinder 16 about a pinned connection formed by laterally-extending transverse hammer pivot pin 100. The lateral direction is defined as extending side to side in the firearm and perpendicularly to longitudinal axis LA. The pivot pin 100 defines a pivot axis of the hammer. Hammer pivot pin 100 has an elongated cylindrical body with circular cross-sectional shape and is received in a transversely extending pivot pin hole 101 in the housing and corresponding hole 101*a* in hammer 18. Hammer pivot pin 100 preferably may be fixed/stationary and non-rotatable relative to the housing in one embodiment. In one implementation, the pivot pin 100 may be fixed in position by an anti-rotation protrusion 102 extending radially and perpendicularly to the cylindrical body of the pin. Anti-rotation protrusion 102 may have a flattened plate or flange-like oblong body in one embodiment. Protrusion 102 engages a complementary configured fixation slot 103 formed in the outer surface of the housing 12 which prevents rotation of the hammer pivot pin relative to the housing such that the pin does not rotate when the hammer is rotated between the cocked and firing positions as the action of the revolver is cycled to discharge the firearm. Other shaped anti-rotation protrusions and mating fixation slots may be used which differ from the illustrated embodiment. In other possible embodiments, the anti-rotation protrusion may be formed on the housing and the complementary configured fixation slot on the hammer pivot pin 100. In yet other possible embodiments, the opposite end portions of the cylindrical shaft of the pivot pin 100 may be non-circular in cross section (e.g. hexagonal, octagonal, square, etc.) and the cross-sectional shape of the pivot pin hole 101 in the housing at a corresponding location may be complementary configured to match which would prevent relative rotation between the hammer pivot pin and its pivot pin hole.

In some embodiments, the hand grip 150 when attached to the downward extending rear grip portion of housing 12 such as grip tang 151 (see, e.g. FIGS. 4-5) may be configured to assist with retaining the hammer pivot pin 100 in the firearm housing 12. As shown in FIG. 1, a portion of the grip 150 may at least partially overlap the anti-rotation protrusion 102 to prevent the pin 100 from working its way outward from the housing due to vibration from repeated firing of revolver 10 or drops. In addition to or instead of the interference created by the grip overlap, some embodiments may include a semi-circular shaped locking clip 152 shown in FIGS. 10 and 11. A C-shaped semi-circular spring clip may be used in some embodiments for the clip 152; however, other suitable shapes and types of clips may be used. Locking clip 152 is mutually engaged with mating circumferential locking grooves 153 and 154 formed inside hammer pivot pin hole 101 and the shaft of hammer pivot pin 100, respectively. Before inserting the hammer pivot pin 100 into the pivot pin hole 101, the clip 152 may be inserted over the shaft of the pin to engage groove 154. When the pivot pin 100 is inserted into its pivot pin hole 101 in housing 12, the clip will then engage the opposing groove 153 in the pivot pin hole 101 to secure the pivot pin to the housing. This arrangement assists with retaining the hammer pivot pin 100 in the firearm housing 12 regardless of the configuration of the hand grip 150. Either the grip 150 or locking clip 152 may be used to resist withdrawal of the hammer pivot pin 100 from the pivot pin hole 101 in housing 12.

Figures 5, 6:
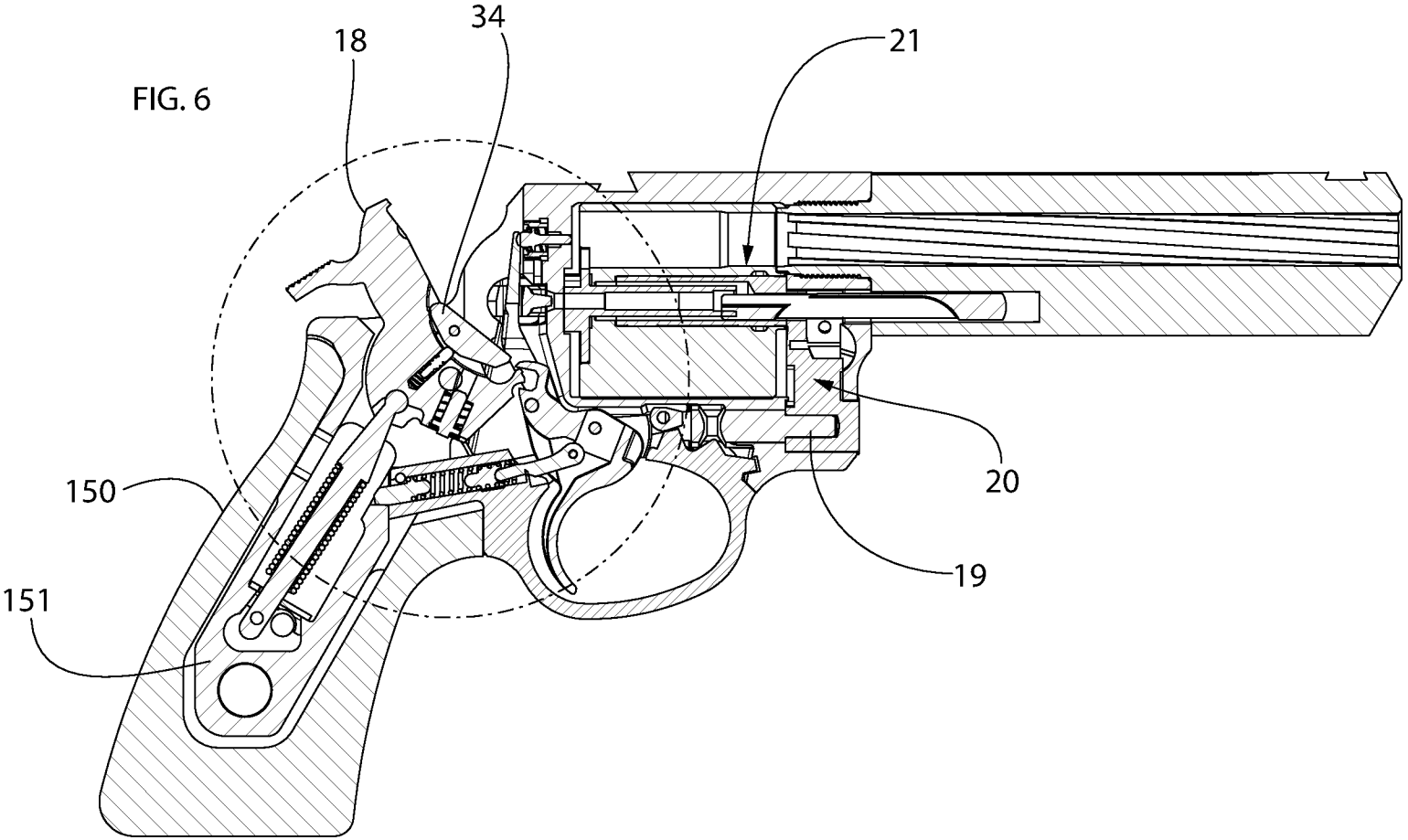
FIG. 5 is a right side cross sectional view thereof.
FIG. 6 is an enlarged detail taken from FIG. 5 showing the hammer in a rearward cocked position.
Figure 6:
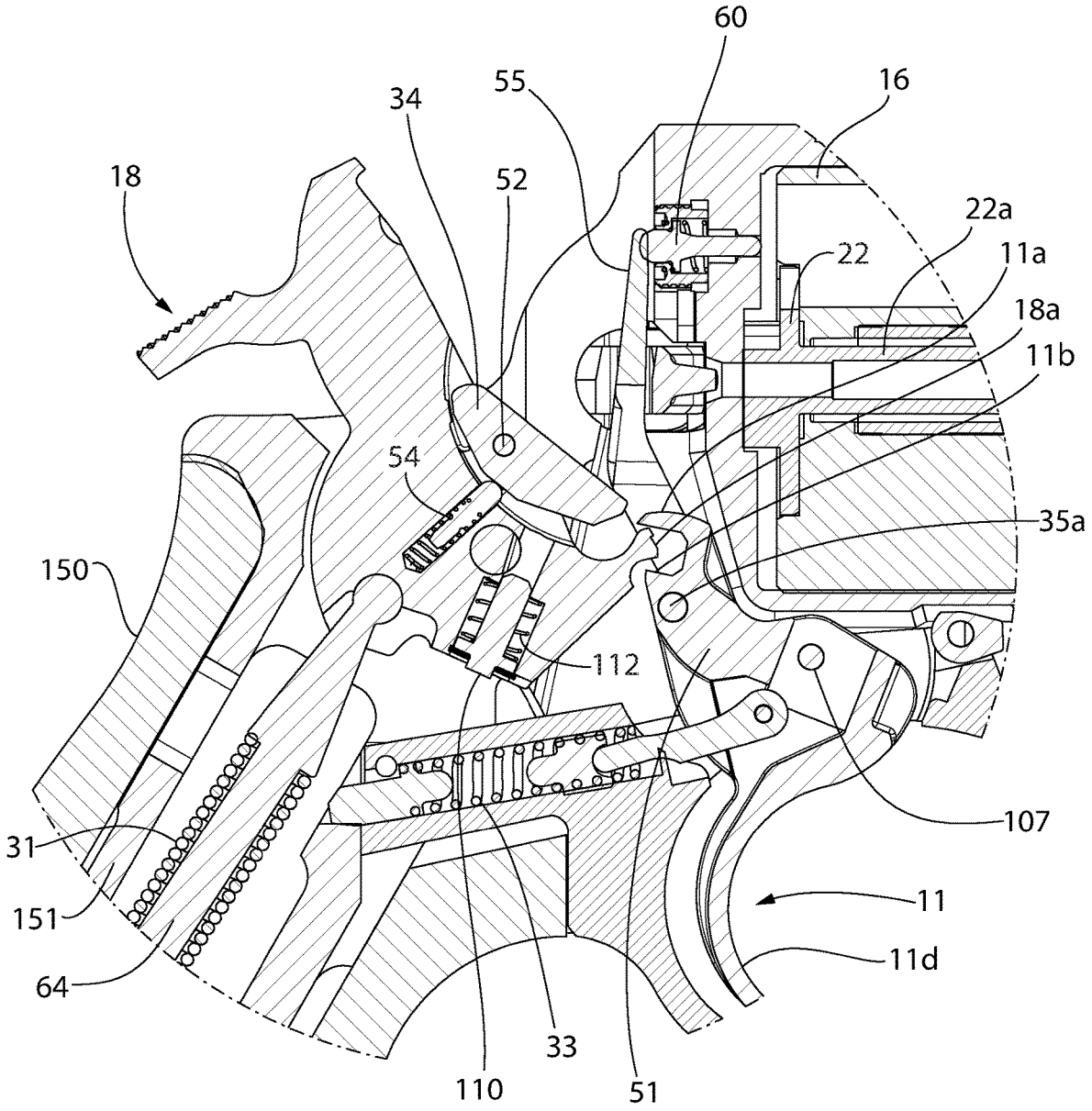
Figure 7:
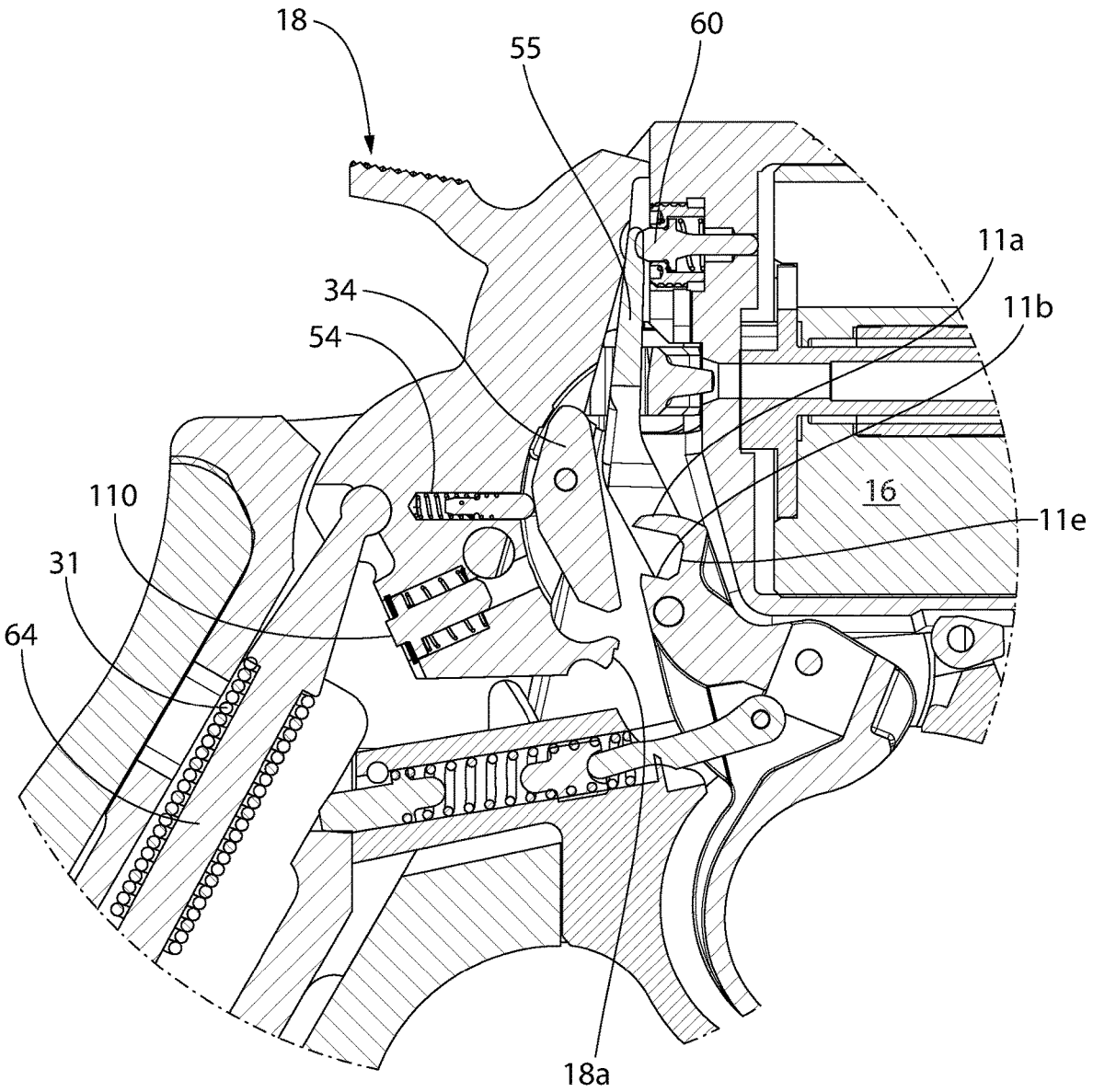
FIG. 7 is a view thereof showing the hammer in a forward firing position.

As shown in FIGS. 6 and 7, hammer 18 is movable in rearward and forward arcuate motions between a ready-to-fire rearward cocked position and a forward firing position for striking transfer bar 55 (or alternatively firing pin 60 directly in those embodiments without a transfer bar). Hammer 18 is biased forward towards firing position by mainspring 31 mounted to the housing 12. Hammer has elongated body including an upper striking portion 104 configured for striking transfer bar 55 (or alternatively firing pin 60 directly) and an enlarged lower operating portion 105 (see, e.g. FIG. 11). Striking portion 104 in one embodiment may include an outwardly extending spur 106 for manually cocking the hammer 18; however, in other embodiments the hammer may be spur-less and completely internal without a spur that protrudes outwards beyond the housing of the firearm.

Figure 8:
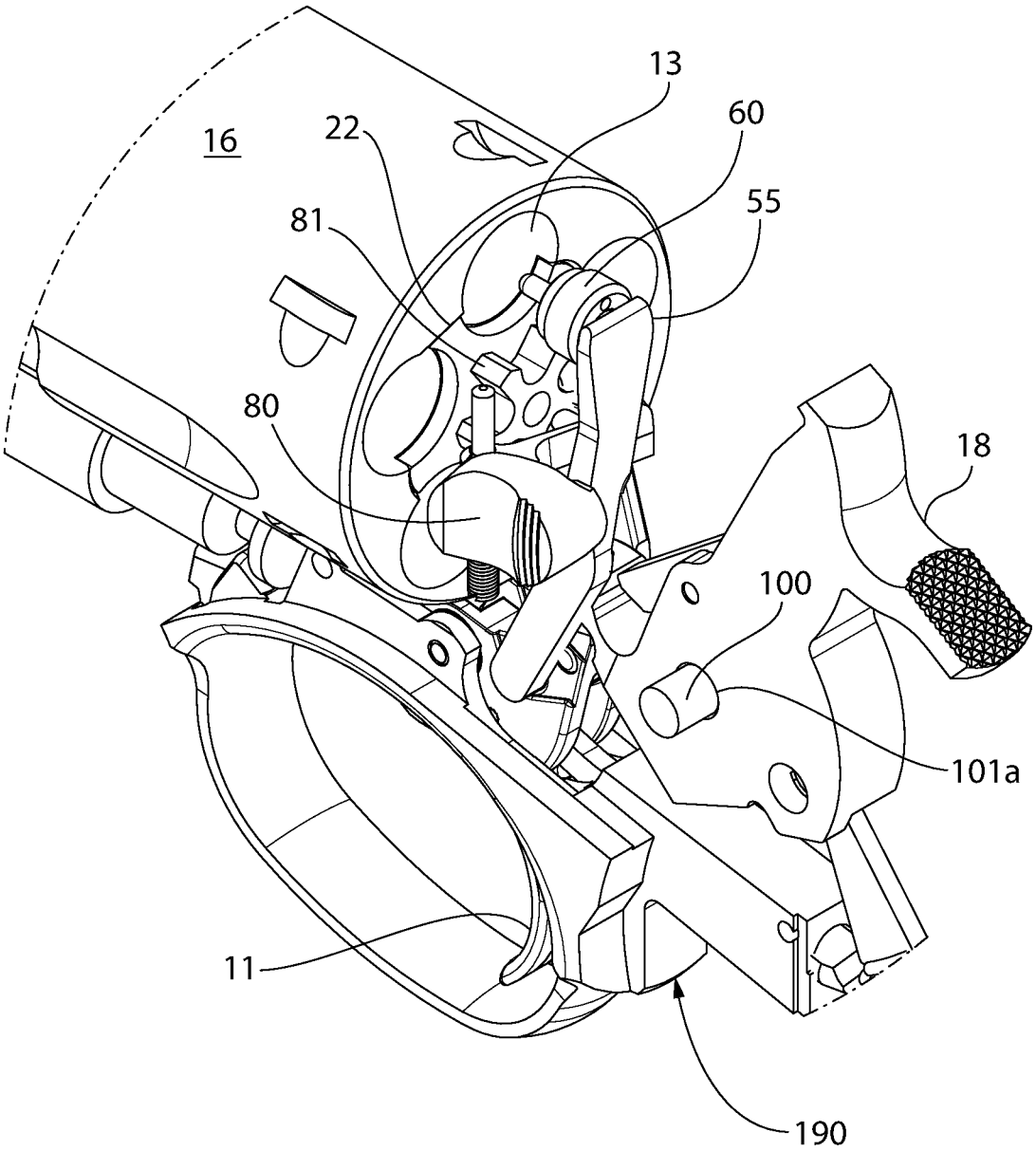
FIG. 8 is a partial left rear perspective view of the firearm of FIG. 1 with cocked hammer.
Figure 9:
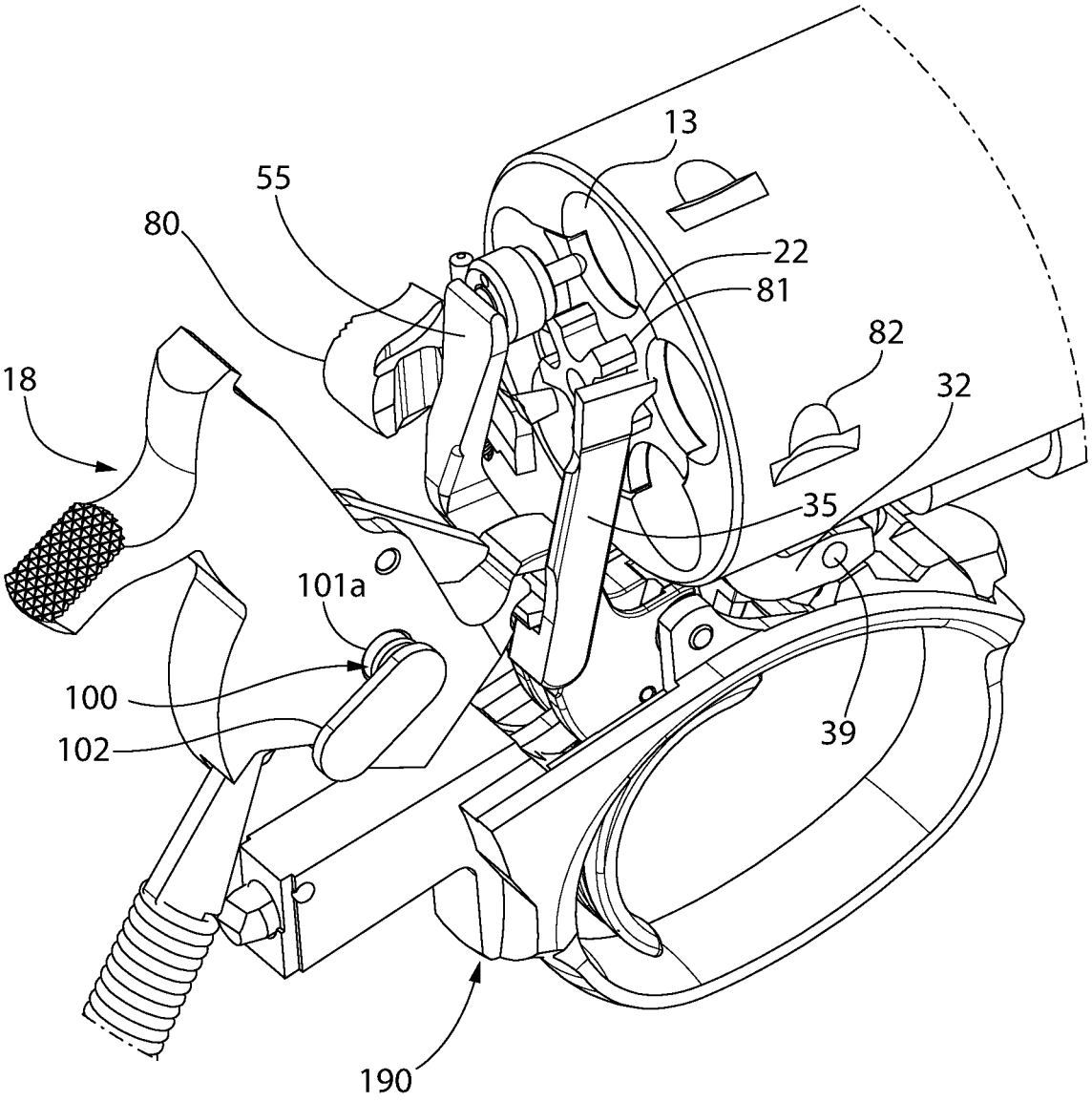
FIG. 9 is a partial right rear perspective view thereof.
Figure 10:
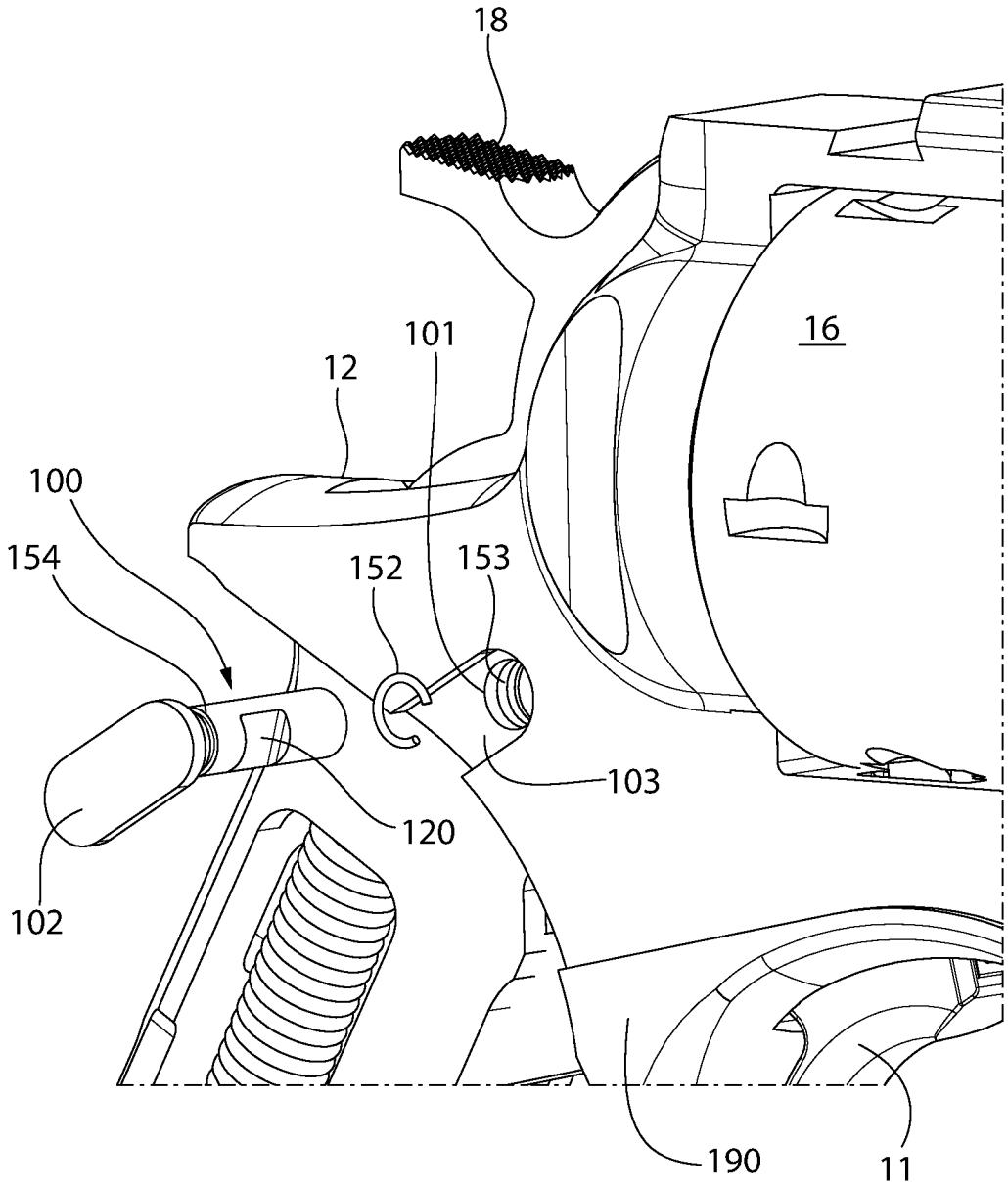
FIG. 10 is a partial right perspective view of the firearm showing the hammer pivot pin with blocking notch exploded out from the hammer shown in the forward firing position.
Figure 11:
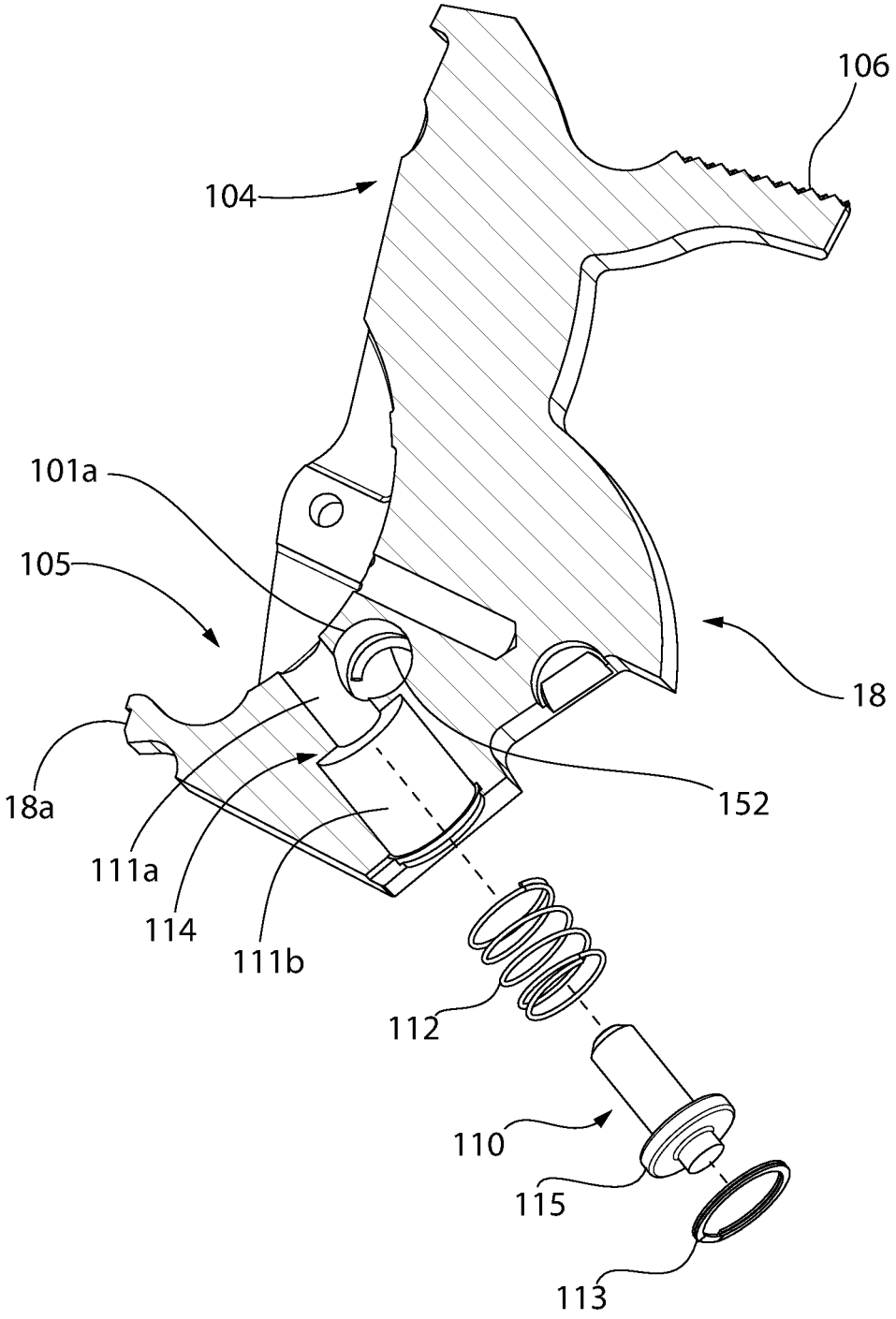
FIG. 11 is an cross-sectional perspective view of the hammer lone with blocking pin assembly exploded out.
Figure 12:
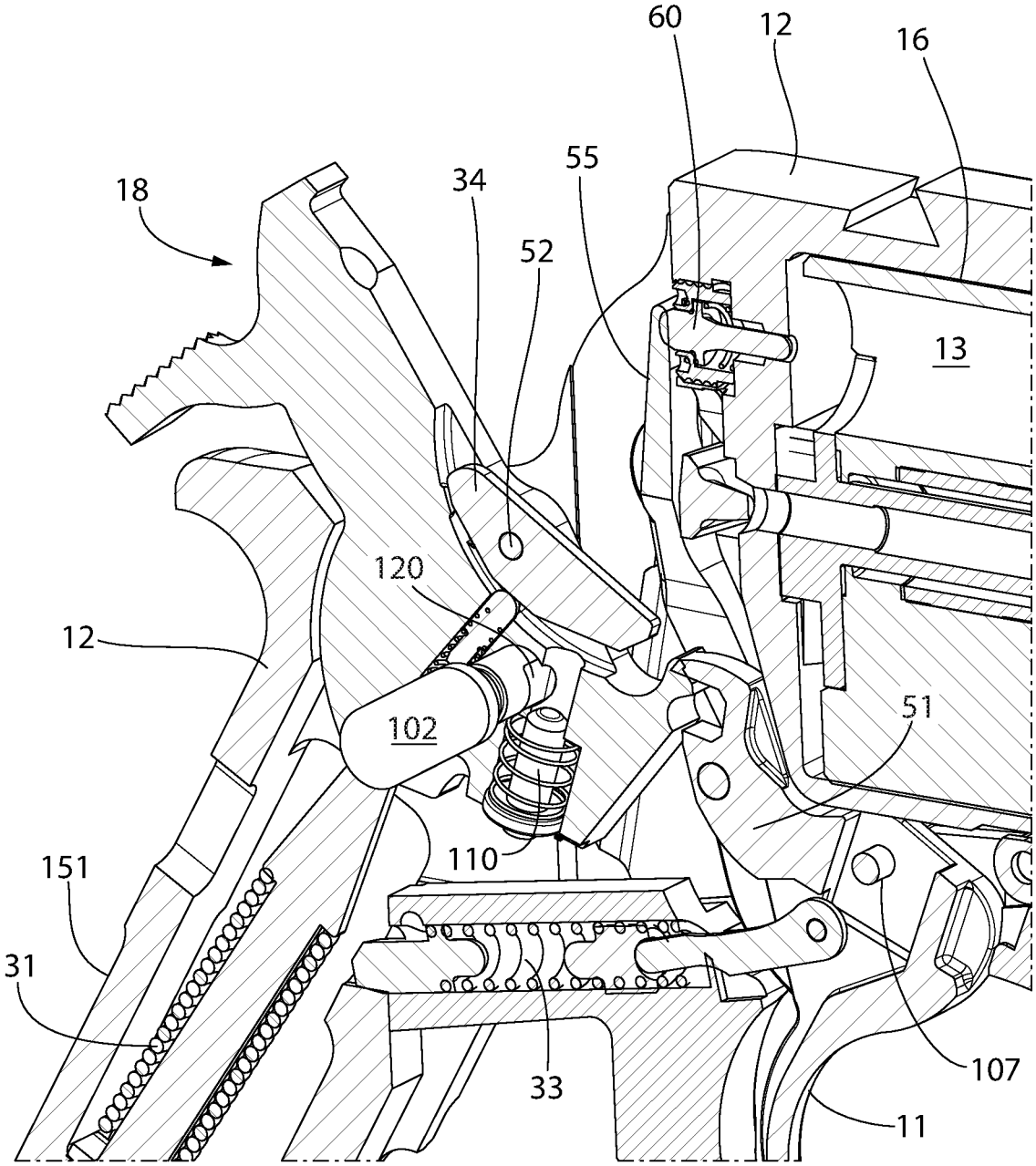
FIG. 12 is a right cross-sectional perspective view of the firing and safety mechanisms showing the hammer in the rearward cocked position and the blocking pin of the same mechanism in a retracted position.
Figure 13:
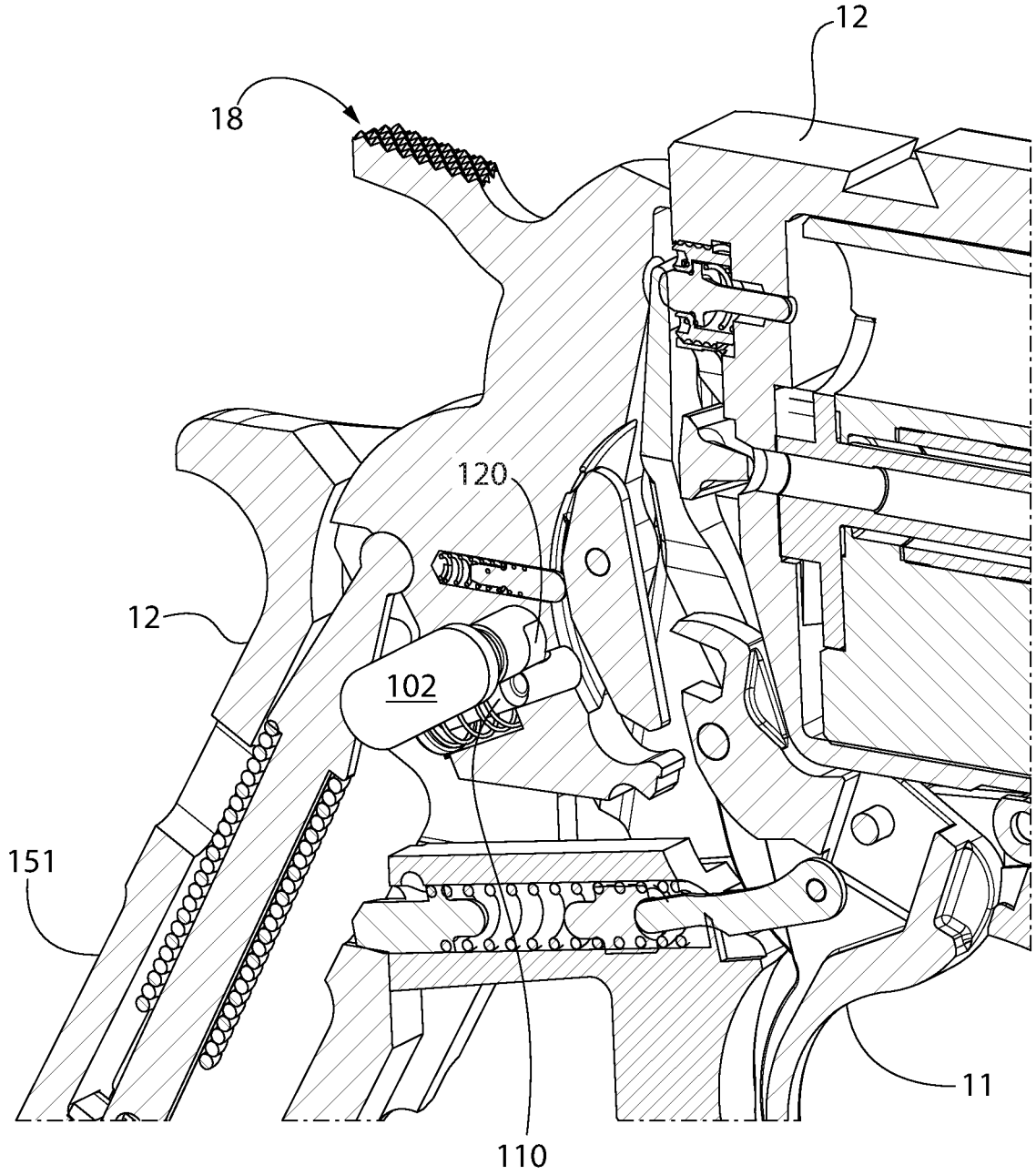
FIG. 13 is a right cross-sectional perspective view thereof showing the hammer in the forward firing position.
Figure 14:
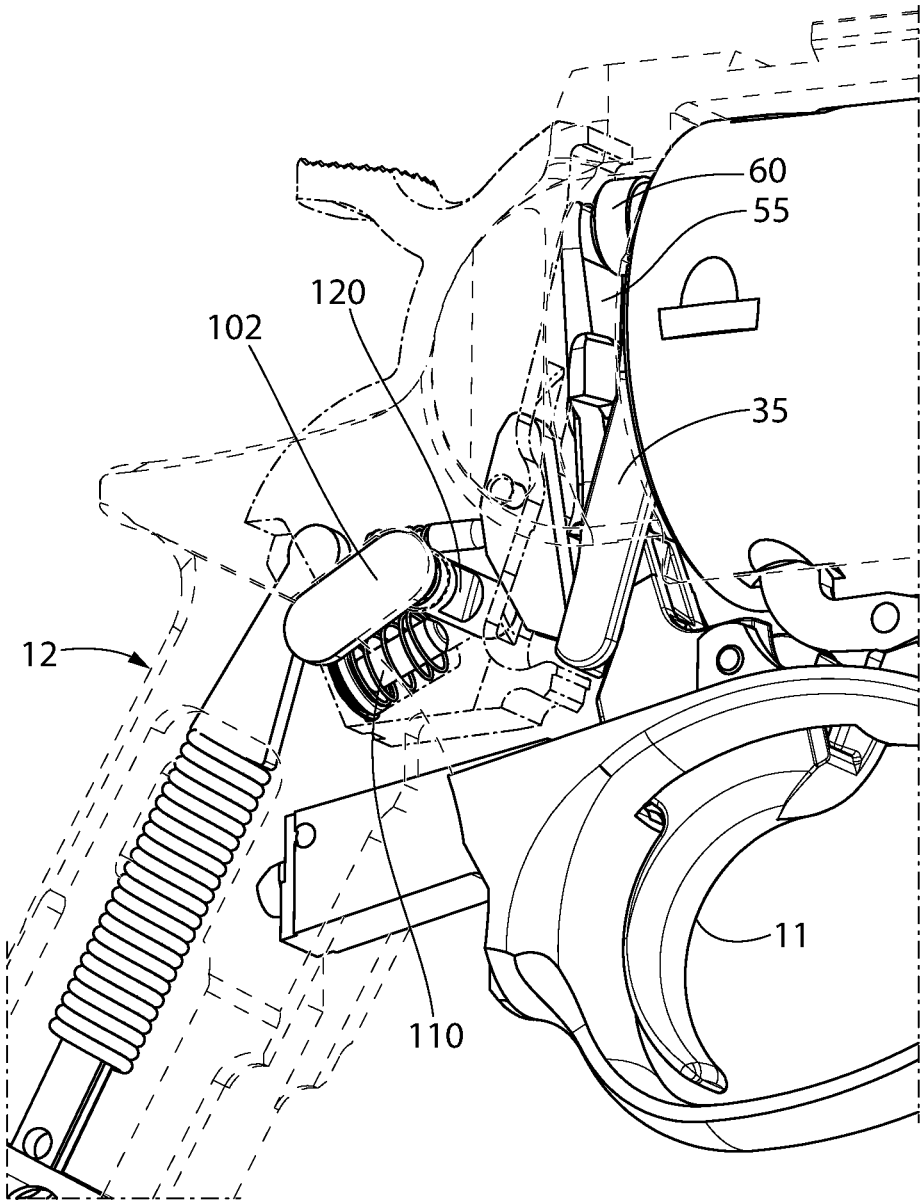
FIG. 14 is right rear perspective view of the firing and safety mechanism with the hammer shown in the firing position and the firearm frame in phantom lines.
Figure 15:
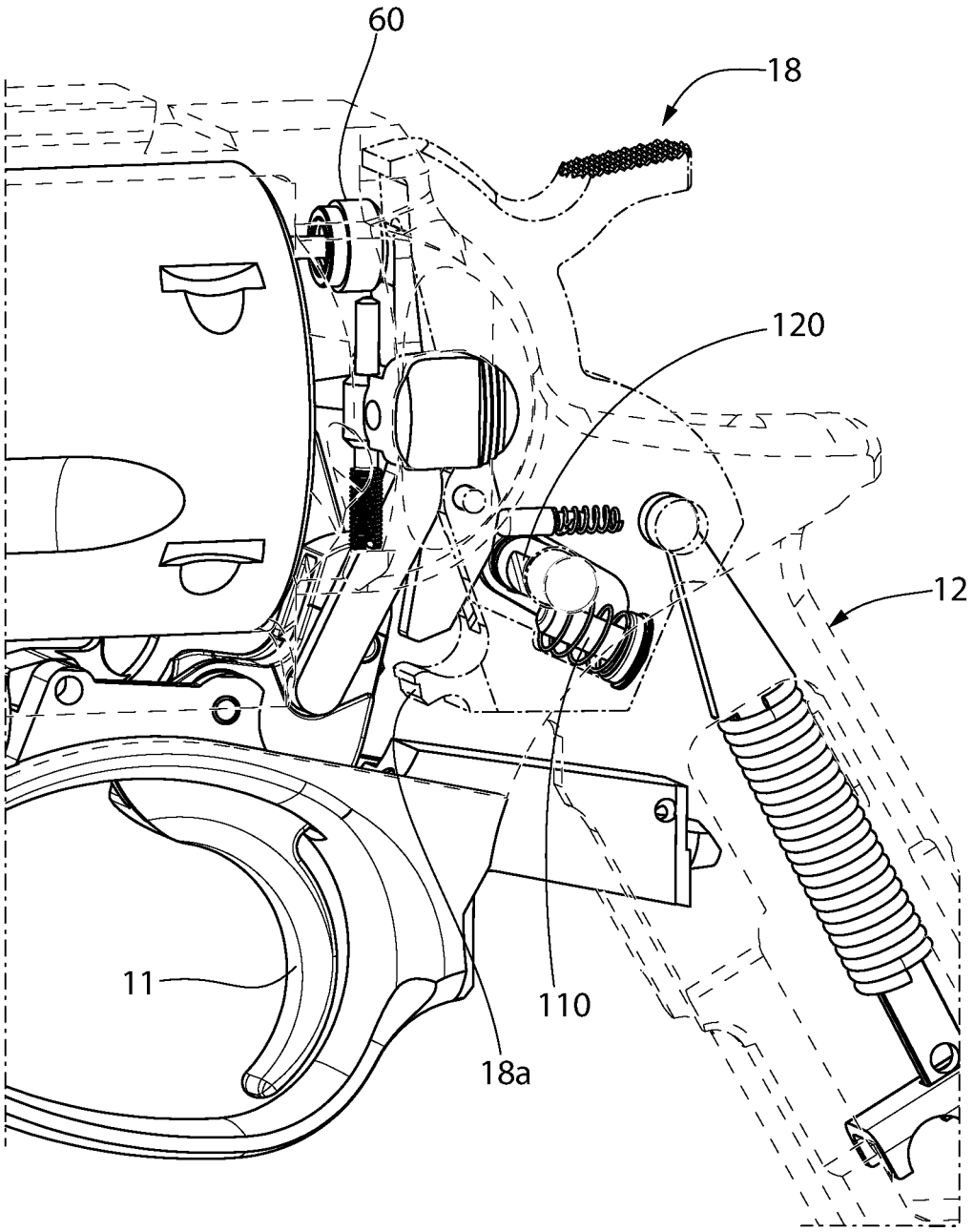
FIG. 15 is a left side perspective view thereof.
Figure 16:
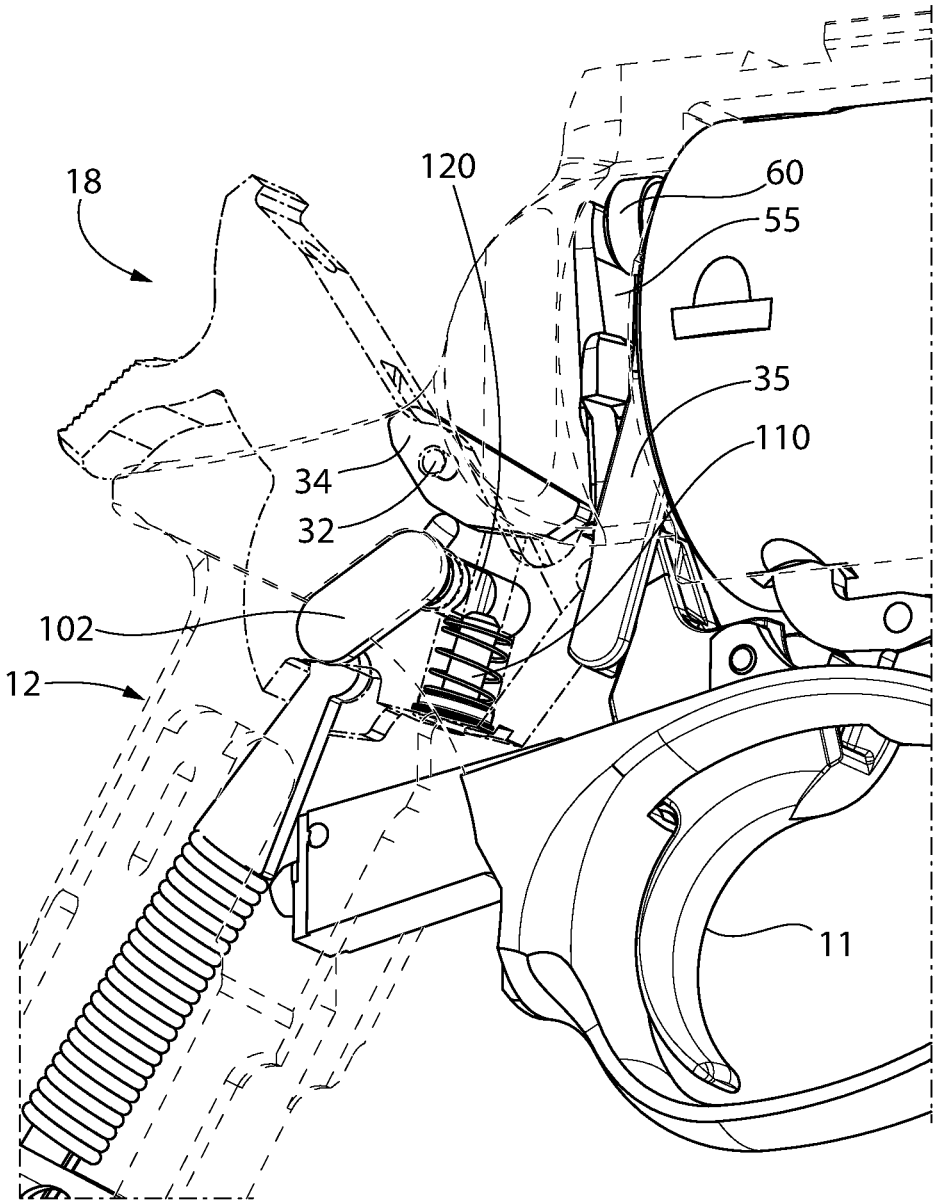
FIG. 16 is a right side perspective view showing the hammer in the cocked position.
Figure 17:
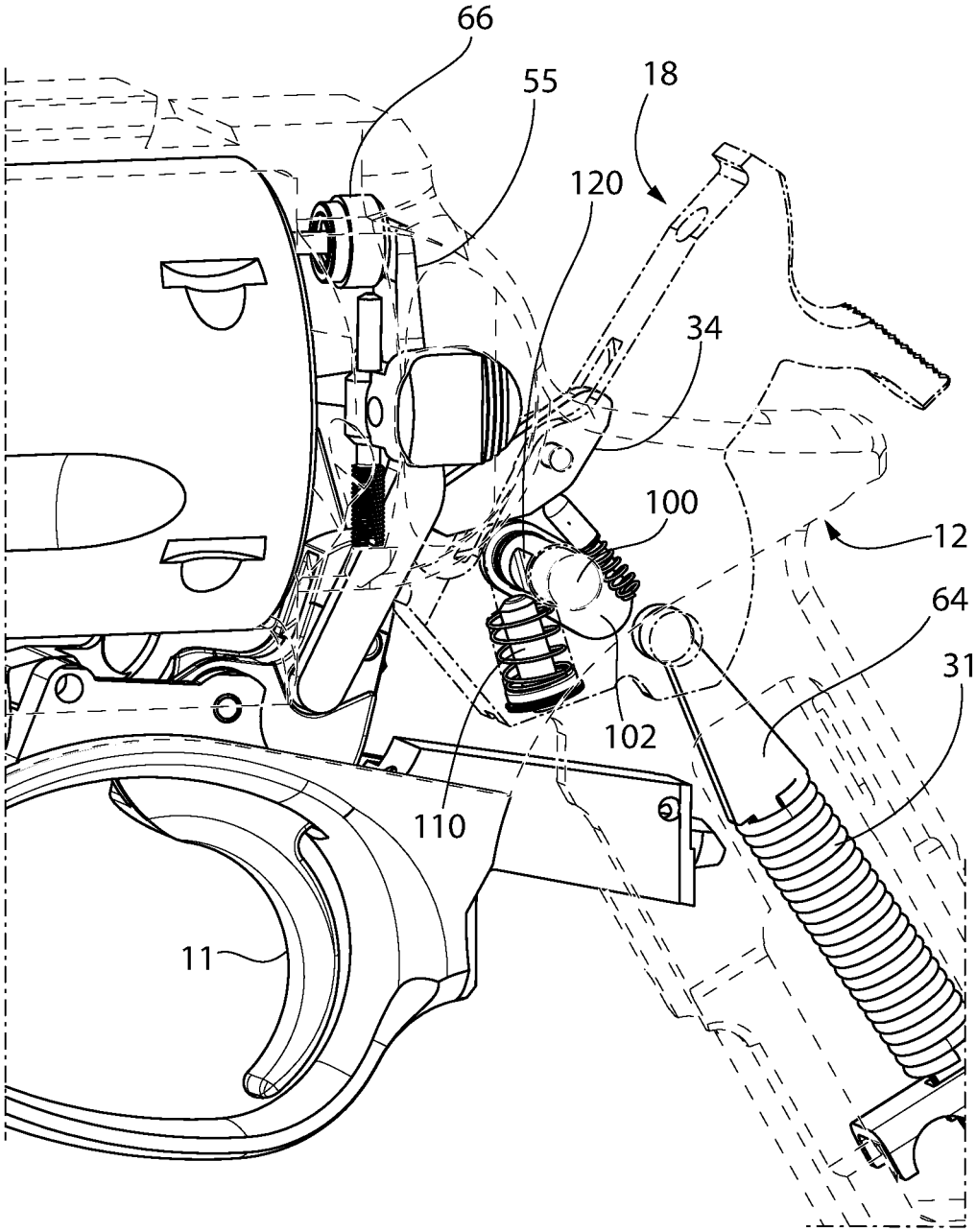
FIG. 17 is a left side perspective view showing the hammer in the cocked position.

Trigger 11 in one non-limiting embodiment as illustrated in FIGS. 8-10 may be pivotably mounted to a trigger housing 190 (or alternatively direction to housing 12 in other embodiments) about a pinned connection formed by pivot pin 107 and moves arcuately in response to a trigger pull by a user. The trigger housing 190 is in turn mounted to the housing by any suitable means. Trigger 11 is biased downwards and forward towards the unpulled state by trigger spring assembly 33. Trigger 11 has a body including a downwardly extending grasping portion 11*d* configured for engaging the user's finger and rearwardly projecting operating extension arm 51 selectively engageable with both the hammer dog 34 and forwardly extending operating foot 18*a* of the hammer. Extension arm 51 defines cam surface 11*a* which is engageable with the hammer dog 34 and a sear edge 11*b* below that engages the hammer operating foot 18*a* to further cock and ultimately release the hammer 18 as the trigger is pulled fully rearward to discharge the firearm. A rearwardly open cutout 11*e* is formed between cam surface 11*a* and sear edge 11*b* to spatially separate these features. In one embodiment, the hammer operating foot 18*a* is configured to partially enter the cutout 11*e* as the trigger is pulled (see, e.g. FIG. 6). The hammer operating foot 18*a* also enters the cutout when the hammer is at rest in the forward position and the trigger is unpulled.

In operation when trigger 11 is pulled in double action firing mode, operating extension arm 51 projecting rearwards from the trigger (i.e. cam surface 11*a*) engages hammer dog 34, which in turn rotates and cocks hammer 18 partially rearwards. As the trigger is pulled further rearward, sear edge 11*b* of trigger 11 next engages operating foot 18*a* of the hammer as the trigger disengages the hammer dog. Pulling the trigger fully further cocks the hammer to the release point in which the trigger extension arm 51 disengages the hammer which rotates forward to the firing position to discharge the firearm. If operating in single action mode, the user may manually draw the hammer back to the cocked position which will remain there until the trigger is pulled to release the hammer and complete the firing sequence.

Referring to FIGS. 6-9, the firing control mechanism of revolver 10 may optionally include a safety transfer bar 55 in certain embodiments. Transfer bar 55 is vertically movable in response to a trigger pull and reduces the likelihood that the revolver will fire in the absence of a trigger pull. In one embodiment, transfer bar 55 may be positioned forward of hammer dog 34 and is movably coupled to trigger 11 via a pinned connection. Spring-biased firing pin 60 is received in a recess formed in revolver housing 12 and axially movable therein to strike a cartridge when loaded in chamber 13. When trigger 11 is pulled, transfer bar 55 moves vertically upwards in response and becomes positioned between hammer 18 and firing pin 60. This fills a gap between the upper striking portion of the hammer an the rear end of the firing pin (see, e.g. FIG. 7). As hammer 18 becomes fully cocked and is then released as described herein, the hammer strikes transfer bar 55 which in turn transfers the force to firing pin 60 propelling it forward to strike the chambered cartridge. In the absence of a trigger pull without the intervening safety transfer bar 55 in place, hammer 18 preferably is incapable of reaching firing pin 60 when the hammer is in its released forward-most position. In some embodiments, the transfer bar 55 may be omitted and the hammer 18 may be configured to strike the firing pin 60 directly. Accordingly, the hammer may be considered as striking the firing pin whether directly or indirectly via the intermediate transfer bar.

Safety Mechanism

The hammer-blocking safety mechanism according to the present disclosure will now be described. Referring generally to FIGS. 1-21, the safety mechanism includes blocking member such as a blocking pin 110 in one embodiment movably mounted to lower operating portion 105 of hammer 18. Blocking pin 110 is slideably mounted in a generally upwardly extending pin bore 111 formed in the hammer. Pin bore 111 has a downwardly open end and an upwardly open end in communication with transverse pivot pin hole 101 which receives hammer pivot pin 100. Pin bore 111 intersects pivot hole 101 to allow the blocking pin 110 to access the hammer pivot pin 100 and engage a blocking feature thereon such as a blocking notch 120 in one embodiment. In one embodiment, the centerline CL2 of pin bore 111 may be offset from the centerline CL1 of the hammer pivot pin hole 101 as shown in the illustrated embodiment. The offset provides engagement between the side of the elongated blocking pin body with the blocking notch 120 to ensure a positive mutual engagement for arresting the hammer. In one embodiment, the pin bore 111 may extend completely through the hammer body from one side to an opposing side (see, e.g. FIG. 18).

FIGS. 18-21 show blocking pin 110 in greater detail. Blocking pin 110 may include an elongated cylindrical body or shaft and a radially projecting and diametrically enlarged annular retention flange 115. Flange 115 may be circular and arranged proximate to the outermost end of the blocking pin. Pin bore 111 includes a smaller diameter section 111*a* adjoining the hammer pivot pin hole 101 and an adjoining larger diameter section 111*b* slideably receiving the diametrically enlarged retention flange 115 of the blocking pin. An annular stepped shoulder 114 separates the smaller and larger diameter sections as shown. A biasing spring 112 disposed in the larger section of pin bore 111 acts on the retention flange to bias the blocking pin away from the hammer pivot pin 100. The blocking pin is retained in its pin bore by an expandable retaining clip 113 which engages the flange (see, e.g. FIG. 11). A C-shaped clip may be used in some embodiments; however, any other configuration of clip suitable for this purpose may be used. The clip prevents spring 112 from ejecting the blocking pin 110 from bore 111. Other type retention means including other type and/or shaped clips, threaded caps/screws, pins, etc. may be used to removably retain the blocking pin 110 in its pin bore 111. One end of spring 112 acts on flange 115 and the opposite end acts on shoulder 114. Spring 112 may be a coiled compression spring in one embodiment; however, other type springs may be used in other arrangement.

Blocking pin 110 is configured and operable to act on hammer pivot pin 100 to completely arrest motion of the hammer 18, or partially arrest rotation of the hammer by substantially slowing movement of the hammer 18 such that it cannot transfer its stored energy to the chambered cartridge sufficiently to detonate the cartridge. The terms "arrest" or related forms as used herein should be broadly construed as including either of the foregoing scenarios which may be considered as blocking the hammer to prevent discharge of the firearm. Blocking pin 110 may be transversely oriented to the hammer pivot pin 100, such as without limitation perpendicularly in some embodiments as shown.

In one embodiment, hammer pivot pin 100 includes a mating blocking feature such as slot-shaped blocking notch 120 formed in the cylindrical body of the pin which is selectively engageable with blocking pin 110 when the safety mechanism is automatically activated. In one embodiment, notch 120 may comprise a flat blocking surface 121 arranged to engage the cylindrical side of the blocking pin. The notch 120 with flat blocking surface may be formed by any suitable method, such as without limitation cutting or milling away a portion of the diameter of the cylindrical hammer pivot pin 100 to a desired depth to produce a flat. The depth of the notch measured to the blocking surface 121 from the full diameter portion of the hammer pivot pin body may be s between about 15-50 percent of the full diameter of the hammer pivot pin 100 in some embodiments. In one non-limiting example, the depth of the notch may be about 25% of the full diameter of the hammer pivot pin 100. This is sufficient to arrest or retard/slow rotation of the hammer 18 so that it cannot either reach the rear end of the firing pin 60, or lightly engages the firing pin (or transfer bar if provided) without sufficient force to detonate a chambered cartridge. Other configurations of blocking notch 120 may be used in other embodiments. For example, without limitation, in lieu of a flat blocking surface as depicted in the notch 120, blocking surface 121 may be concavely curved in other embodiments and complementary configured to the radius/curvature of the blocking pin shaft for a curved-to-curved interface in lieu of flat-to-curved interface. Accordingly, there are many possibilities and the blocking notch configuration is expressly not limited to that illustrated.

Other configurations of a blocking member not limited to a straight cylindrical member such as blocking pin 110 are possible to engage a mating blocking feature on the hammer pivot pin 100. In some various other embodiments contemplated, the blocking member may be a straight shaft or pin with polygonal cross section (e.g. square, hexagonal, octagonal, etc.), non-polygonal other than circular cross section (e.g. oval/ellipsoidal), L-shaped, a pin or lever that pivotably rotates about its own separate pivot axis on the hammer, etc. The hammer pivot pin 100 therefore would have a blocking featured configured to cooperate with these possible alternative configurations of blocking members to arrest the motion of the hammer. Accordingly, neither the blocking member nor notch are limited to the blocking pin and blocking notch disclosed herein.

Figure 19:
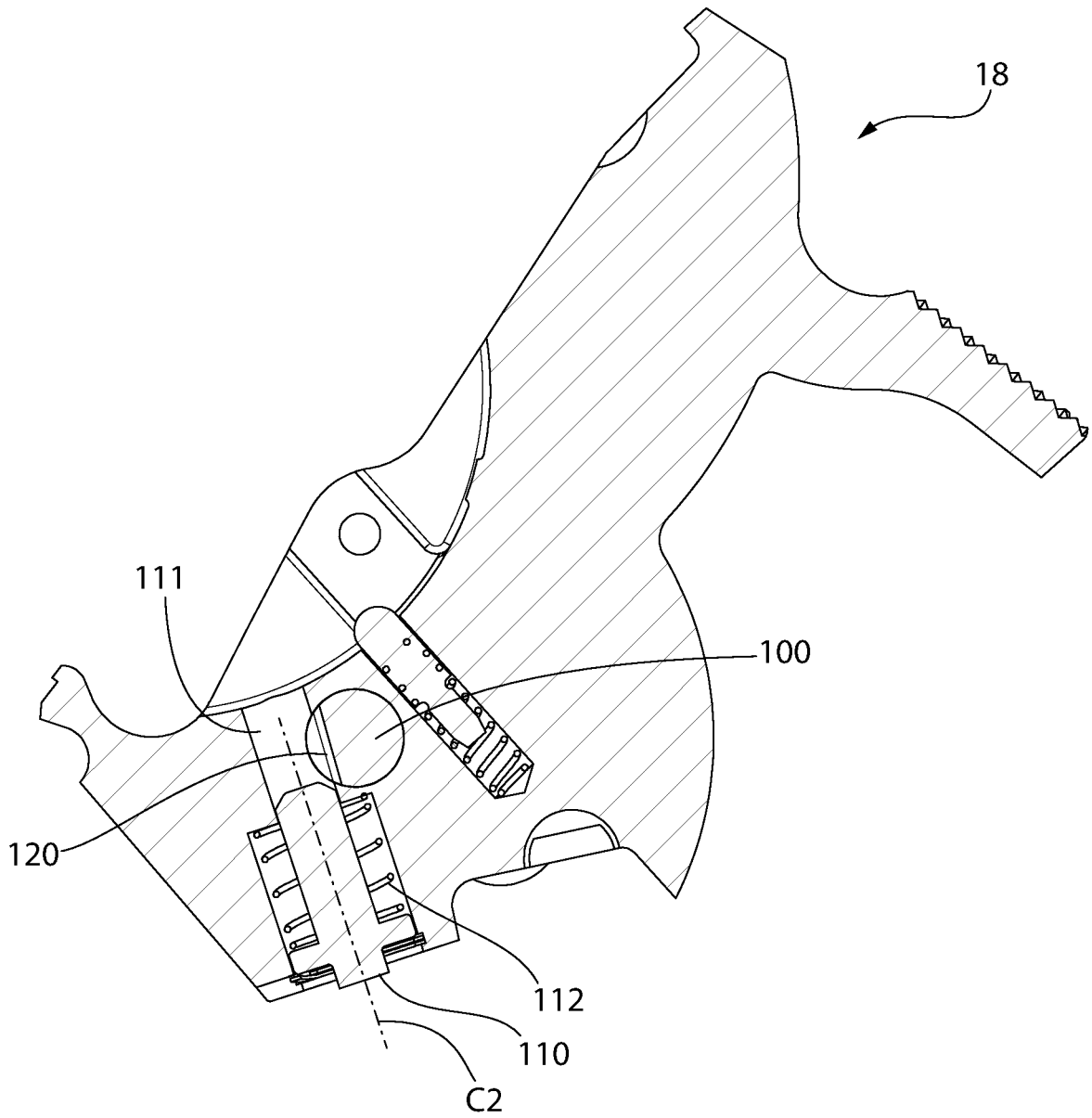
FIG. 19 is a view thereof showing the blocking pin unactuated but now aligned with the blocking notch of the hammer pivot pin.
Figure 20:
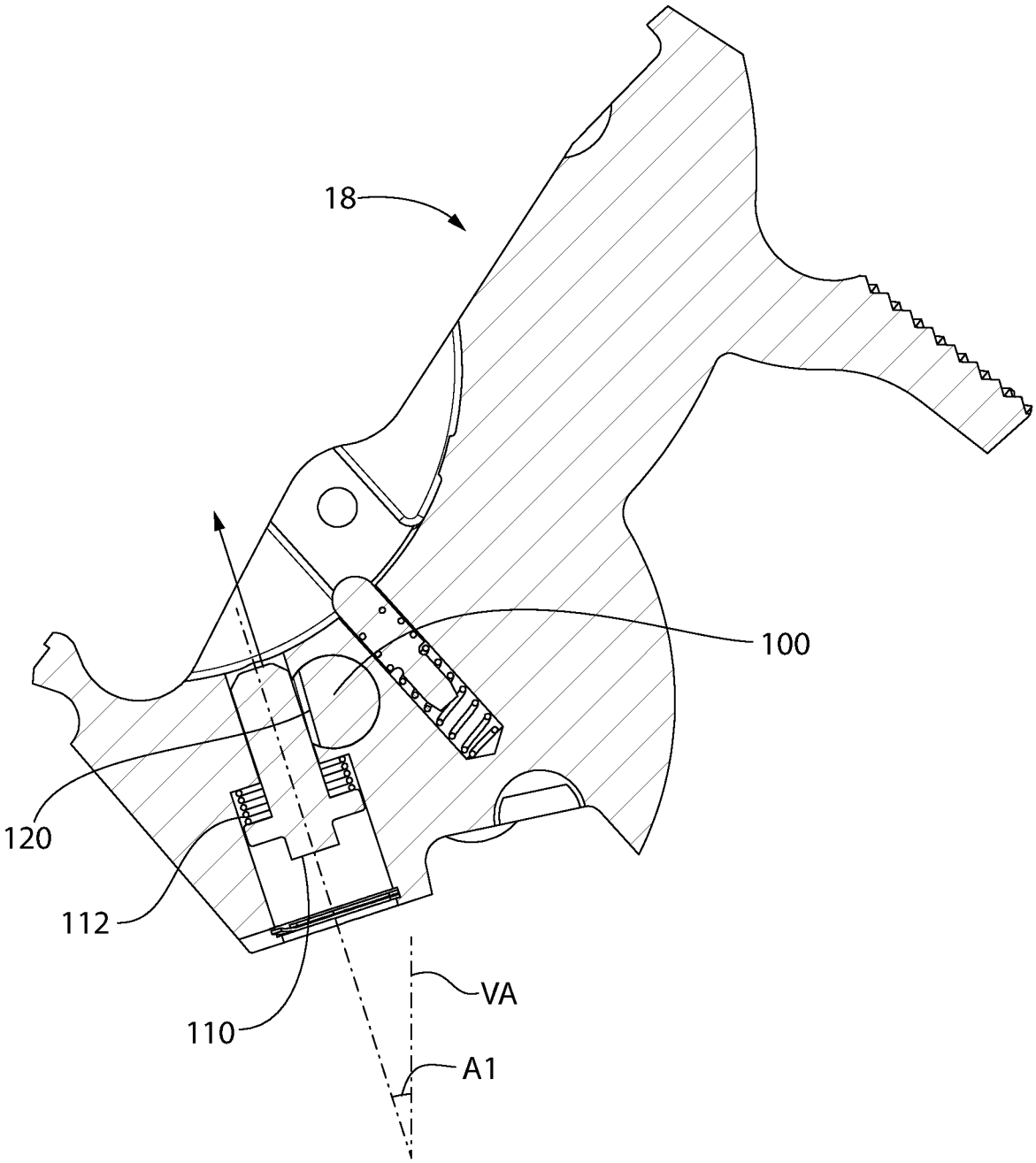
FIG. 20 is a thereof showing the blocking pin actuated and in a projected position to engage the blocking notch of the hammer pivot pin.

The blocking pin 110 is linearly moveable between a retracted non-blocking position misaligned and not blockingly engageable with the blocker notch 120 (i.e. blocking surface 121) of the hammer pivot pin 100, as shown in FIG. 19 and a projected blocking position aligned and blockingly engageable with the blocking notch, as shown in FIG. 20. Spring 112 acts to bias the blocking pin towards the retracted non-blocking position. Because the centerline CL1 of the hammer pivot pin hole 101 in hammer 18\ (and concomitantly hammer pivot pin 101) is offset from the centerline CL2 of the blocking pin bore 111 (and concomitantly blocking pin 110), the cylinder side of the blocking pin shaft is positioned to engage the flat blocking surface 121 of the hammer pivot pin 100 when the blocking pin is in the projected blocking position.

Figure 18:
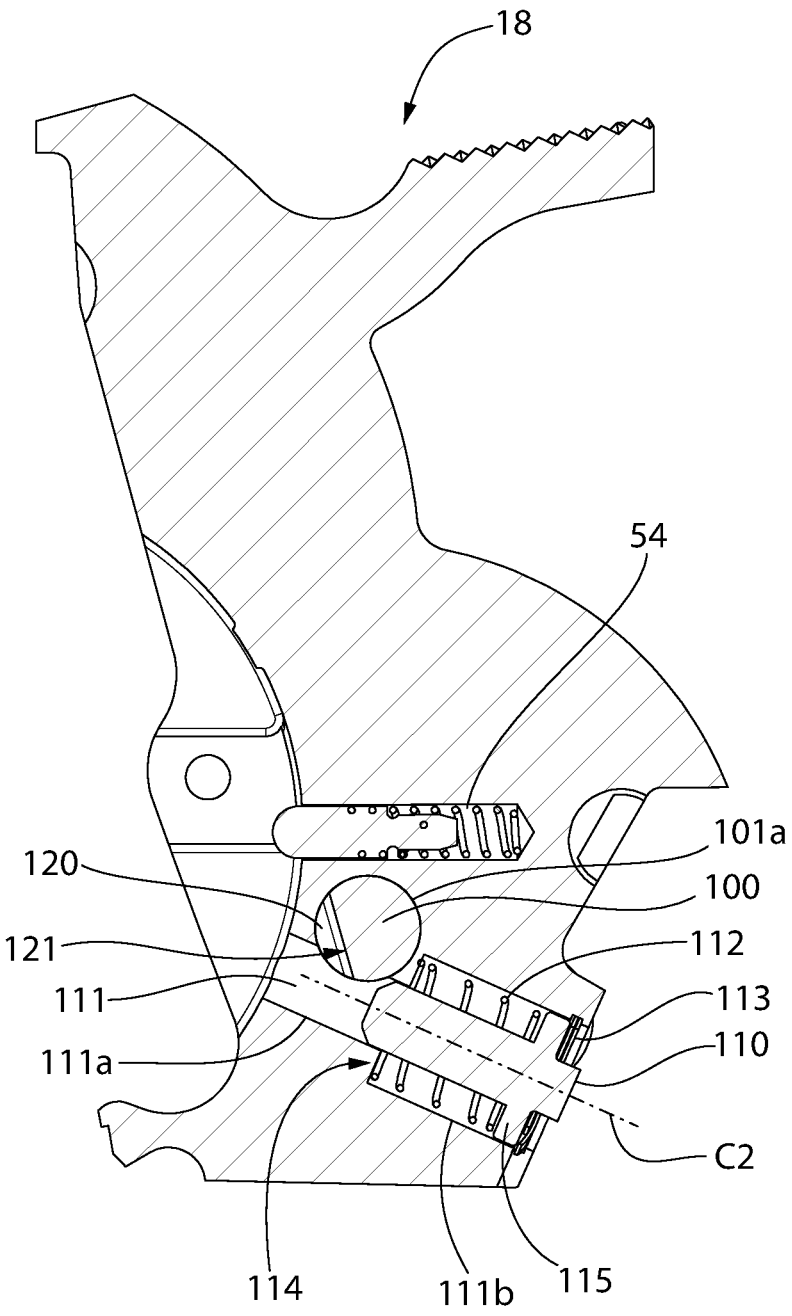
FIG. 18 is a side cross-sectional view of the hammer in the firing position showing the blocking pin of the safety mechanism unactuated and misaligned with the blocking notch of the hammer pivot pin.

The position of the blocking pin 110 is controlled by the rotational position of the hammer 18. When the hammer of the double action revolver 10 is not in the cocked position, the blocking pin 110 is captured between the retaining clip 113 and the full diameter portion of the hammer pivot pin 100 as seen in FIG. 18, thereby preventing deployment of blocking pin. As shown, blocking pin 110 is therefore also not aligned to move and engage blocking notch 120 of hammer pivot pin 100 if the revolver 10 were dropped or otherwise impacted. When the hammer is in the fully cocked position represented in FIG. 19, the blocking pin 110 is captured by the retaining clip in one direction but is now aligned with the blocking 120 notch in the hammer pivot pin 100. Accordingly, the blocking pin 110 is only restricted from linear movement in the direction towards the blocking notch 120 of the hammer pivot pin 100 by force of the spring 112. In the case that the firearm is then dropped or otherwise impacted, the momentum of the blocking pin 110 will create maximum movement of the blocking pin from the non-blocking to blocking position when the centerline axis C2 of the pin 110 is substantially vertically oriented on contact with or by a hard surface (see, e.g. FIG. 20). As the axis C2 of the blocking pin deviates from vertical, the resulting sliding movement of the blocking pin to the blocking position may be reduced but still sufficient to actuate and move the pin when the blocking pin is oriented at an angle A1 up to and including about 40 degrees to vertical (VA). If the firearm drop or impact condition causes the hammer to disengage from the trigger 11 when the blocking pin 110 is in the deployed blocking position, the blocking pin will move in an arcuate path with the lower operating portion 105 of the hammer 18 until the blocking pin abuttingly engages the blocking notch 120 in the stationary hammer pivot pin 100 (see, e.g. FIG. 21). This engagement arrests further movement of the hammer sufficient to discharge the firearm. This engagement will stop the rotation of the hammer and prevent the hammer from reaching the firing pin (or transfer bar) and transferring impact energy to the cartridge. This may be accomplished by either: (1) holding the hammer in this blocked position preventing any substantial motion thereof initially, (2) allowing the hammer to move slightly and rebound off the blocking pin upon engagement to hold the hammer in the blocked position without reaching and striking the firing pin or intermediate transfer bar 55, or (3) slowing/retarding the speed of the hammer rotation to reduce energy transferred to the firing pin below the level required to detonate the chambered cartridge. All three blocking scenarios will prevent the firearm from discharging. While a hammer pivot pin 100 with complete blockage of rotation may be shown, any blocking engagement between the blocking pin 110 and blocking notch 120 of the hammer pivot pin 100 that slows or robs sufficient energy from the hammer to prevent discharge of the firearm could also be used.

The speed and displacement of the blocking pin 110 are dependent on many factors including without limitation the mass of the blocking pin, the stiffness of the blocking pin spring 112, the orientation of the blocking pin, and in the case of a drop, the height, orientation and condition of the contact surface. The mass of the blocking pin and the spring design are mutually selected to allow the momentum and mass of the blocking pin to move under a wide range of impact conditions to overcome the spring force, such as at different drop heights and impact angles. During these events, the blocking pin 110 will move from the retracted (resting) position until it reaches either full travel in pin bore 111 or at least contacts the blocking notch 120 of hammer pivot pin 100 when moved to the projected position. After reaching full travel if it has not contacted the notch 120 of the hammer pivot pin 100, the blocking pin spring 112 will return the blocking pin back to the starting retracted position.

Depending on the distance that the blocking pin 110 travels and the rotational speed of the hammer 18, the hammer may be stopped as the blocking pin is traveling away from the starting retracted position or as it returns. The distance that the blocking pin can travel is also important because the farther the pin can travel, the more time the hammer has to contact the blocking pin. If desired, in other possible embodiments it could be possible in some applications to have a second blocking pin operating on the same centerline axis C2 as the first blocking pin, but activated in the opposite orientation. It may also be possible in other embodiments to add other blocking pins in different orientations provided the hammer pivot pin 100 can be notched in the same direction as the other pins. It would also be possible in some embodiments to replace the notch 120 in the hammer pivot pin 100 with a transversely oriented hole (to the centerline of the pin) contained within the hammer pivot pin in or through which the blocking pin 110 is insertable when the pin moves to its projected position when the firearm is dropped/impacted. Engagement between the pin and blocking hole of the hammer pivot pin arrests motion of the hammer 18. The blocking hole may be formed between opposing sides of the hammer pivot pin.

In the event the blocking pin 110 is activated, and the hammer 18 is stopped and held by the blocking pin, the firearm will not be able to be fired. The hammer must be moved back towards the cocked position to take the load off of the blocking pin and allow the spring 112 to move the blocking pin back out of the way of the hammer pivot pin. At this time, the firearm could be fully cocked and fired, or the hammer could be lowered/moved forward to the uncocked (forward firing) position. In some double action revolvers, it may be possible to position the blocking pin in such a way as to allow the pulling of the trigger to cock the hammer, thereby disengaging and releasing the blocking pin from the hammer pivot pin blocking notch 120 which returns the blocking pin to the retracted position and firing the revolver. In other firearms it may be necessary to cycle the action using whatever means is appropriate for that type of firearm.

In other situations, the hammer 18 might rebound after the blocking pin impact, which would allow the blocking pin to reset and then let the hammer fall to the uncocked forward firing position. If this occurs, either the hammer will not have enough energy remaining to fire the cartridge or contact other intermediary elements, such as the transfer bar 55 previously described herein if provided, which will prevent the hammer from contacting the firing pin or transfer bar. If this occurs the user would be able to cock the hammer in single action or double action mode and continue firing the revolver The blocking pin 110 preferably is made of a metallic material capable of withstanding impact loads. In some embodiments, the blocking pin 110 may also optionally be finished on its exterior surface with an anti-friction coating such as nickel Teflon or other to reduce friction and drag between the pin and hammer pivot pin blocking notch and pin bore 111. While all of the concepts shown and discussed so far rely on a sliding blocking pin 110 and a stationary or fixed hammer pivot pin 100, the same concept may be applied to designs that do not use a sliding blocking pin. The simplest description of the mechanism may include a fixed or rotationally restricted hammer pivot pin, working in conjunction with additional part or parts integrated within the hammer assembly, that when moved by specific momentum based loading conditions, creates sufficient contact between the hammer assembly and the pivot pin to stop or restrict rotational motion of the hammer. One different non-limiting example of this would be a hammer blocking component the pivots about an axis in lieu of slides linearly as previously described herein, other than the axis of the hammer pivot pin. The pivotable blocking component thus would be used in place of the sliding blocking pin 110. In other embodiments, it would also be possible to replace the blocking pin spring 112 with a detent type feature, or a magnet, to hold the blocking pin or other component in the inactive position.

An exemplary method for blocking a firing mechanism of a firearm will now be described. The method begins by providing the firearm which may be a revolver 10 in one embodiment having a firing mechanism including hammer 18 mounted and movable about hammer pivot pin 100 between rearward cocked and forward firing positions as previously described herein. The trigger 11 is operable to cock and release the hammer. Slideably movable blocking pin 110 is mounted to the hammer, generally and substantially below hammer pivot pin 100.

The method may continue by positioning the hammer 18 in the firing (forward) position. In this position, the blocking pin 110 is misaligned with blocking notch 120 on the hammer pivot pin 100 (see, e.g. FIG. 18). If the firearm were impacted by a hard bump or being dropped on a relatively hard surface, the blocking pin 110 would attempt to move in its pin bore 111 but would be blocked by part of the full diameter portion of the cylindrical pin body or shaft such that the blocking pin cannot access the blocking notch.

The method may continue by rotating the hammer 18 to the cocked position shown in FIG. 19. Rotating the hammer results in aligning the blocking pin 110 with the blocking notch 120 on the hammer pivot pin 100 such that the blocking pin is now able to slide towards the hammer pivot pin 100 and engage the blocking notch. It bears noting that FIG. 19 shows the blocking pin being unactuated and in the non-blocking position.

Figure 21:
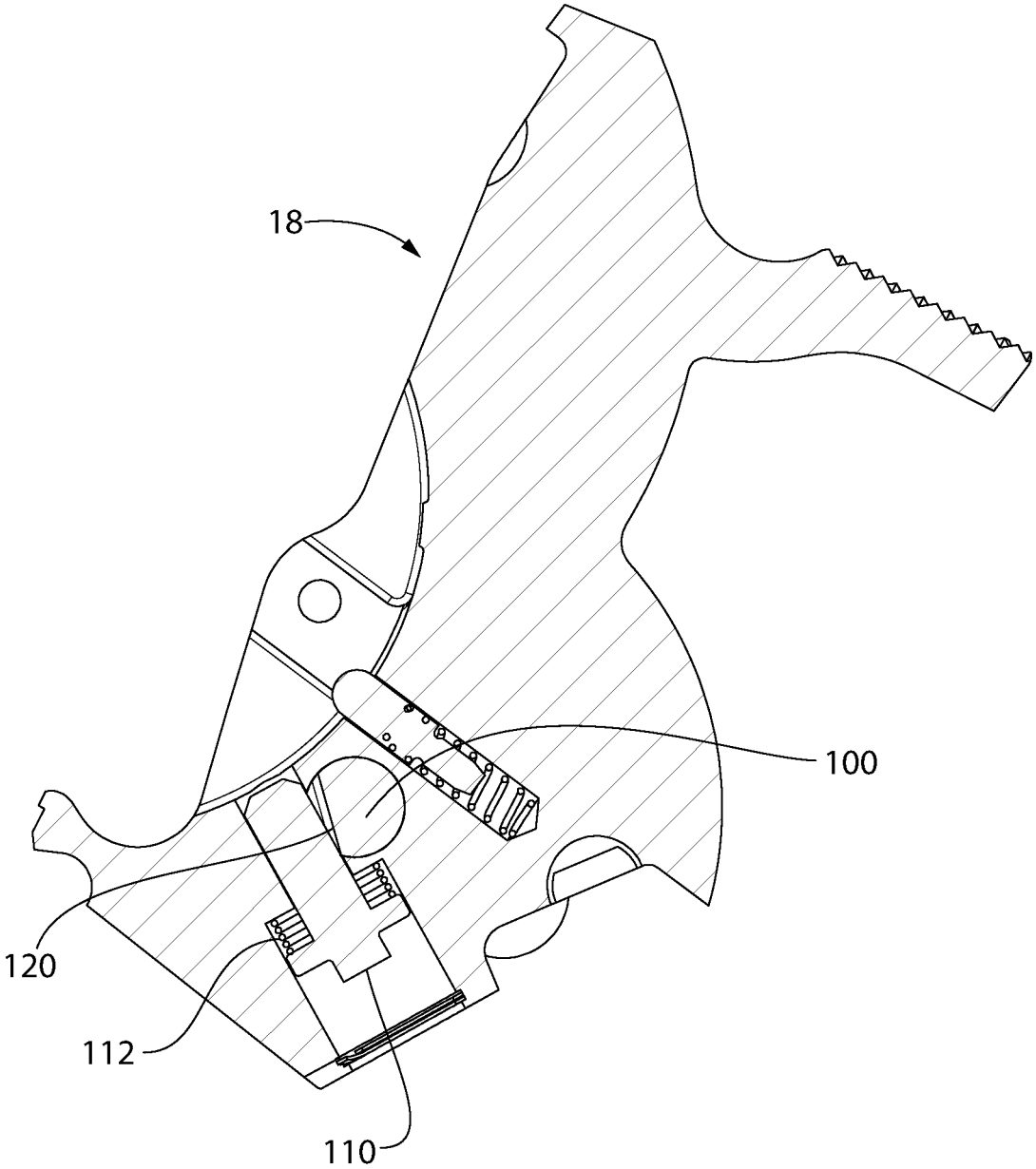
FIG. 21 is view thereof showing the blocking pin engaged with the blocking notch of the hammer pivot pin to arrest movement of the hammer.

The next action which may occur is impacting the firearm on a relatively hard surface, such as by dropping the firearm or bumping it without a drop while the hammer 18 is cocked. The impact force on the firearm automatically actuates and moves the blocking pin 110 from the retracted non-blocking position disengaged from the blocking notch 120 of the hammer pin 100 to a projected blocking position shown in FIG. 20 in which the blocking pin slideably moves to engage the blocking notch 120 of the hammer pivot pin. The blocking pin is thus now actuated via the impact force. This results in arresting rotation of the hammer 18 from the cocked to forward firing position to prevent discharging the firearm via the blocking pin engagement with the blocking notch. As the hammer 18 tries to rotate forward, the shaft of the hammer pivot pin 100 at blocking notch 120 will be blocked by the blocking pin 110 as shown in FIG. 21. The blocking pin 110 may remain automatically engaged with the blocking notch 120 and hammer pivot pin 100 until released due to the main spring 31 which always biases and attempts to move the hammer 18 forward to the firing position.

The user may then disengage and release the blocking pin 110 from hammer pivot pin 100 (i.e. blocking notch 120 thereon) by manually cocking and rotating the hammer slightly rearward. Spring 112 will then automatically return the released blocking pin 110 to its retracted non-blocking position shown in FIG. 19 even though the hammer remains cocked.

It bears noting that in the case of a single action revolver, the user must manually cock the hammer which remains there until the trigger is pulled to release it and discharge the firearm. In the case of a double action revolver, the user may optionally manually cock the hammer as well which simulates the foregoing single action operation. Normally for a double action revolver, fully pulling the trigger both rotates the hammer to the cocked position and then releases the hammer to discharge the firearm as the hammer is drawn farther and farther rearward by the trigger pull. Some users prefer to use a double action revolver in the simulated single action mode by manually cocking the hammer since a lighter trigger pull force can release the hammer than when shooting in double action mode. This translates into greater shooting accuracy. The present hammer-blocking safety mechanism is intended to disable firing of the firearm when the revolver is impacted in the single action mode with already cocked hammer, whether either a single action revolver or double action revolver is being used.

In implementations where the present safety mechanism is used on a hammer-fired semiautomatic pistol or rifle, the hammer is automatically maintained in the rearward cocked between firing rounds. The blocking pin 110 therefore will deploy to arrest the hammer if the firearm is dropped or otherwise impacted.

While the foregoing description and drawings represent exemplary ("example") embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A firearm with safety mechanism comprising:

a housing;

a spring-biased hammer rotatably supported by a transverse hammer pivot pin fixed in position relative to the housing, the hammer movable between a rearward cocked position and a forward firing position;

a trigger operable to release the hammer from the cocked position to discharge the firearm;

a blocking feature formed on the hammer pivot pin; and a hammer blocking member movably mounted to the hammer and selectively engageable with the blocking feature;

wherein rotating the hammer from the firing position to the cocked position aligns the blocking member with the blocking feature of the hammer pivot pin such that the blocking member is movable to engage the blocking feature.

2. The firearm according to claim 1, wherein the blocking member is slideably mounted in a pin bore formed in the hammer and rotatably movable therewith about the hammer pivot pin.

3. The firearm according to claim 2, wherein the blocking member is transversely oriented to the hammer pivot pin.

4. The firearm according to claim 3, wherein the hammer pivot pin has a cylindrical body and the blocking feature comprises a flat blocking surface engageable with the blocking member.

5. The firearm according to claim 4, wherein rotating the hammer to the cocked position linearly aligns the blocking feature and the blocking member to allow sliding engagement between the blocking member and blocking surface, and rotating the hammer to the firing position linearly misaligns the blocking feature and blocking member to prevent engagement between the blocking member and blocking surface.

6. The firearm according to claim 4, wherein the blocking feature is a notch having a depth measured to the blocking surface from a full diameter portion of the hammer pivot pin is between about and including 15-50 percent of the full diameter of the hammer pivot pin.

7. The firearm according to claim 2, wherein the hammer pivot pin is received in a transversely extending pivot pin hole in the housing and the pin bore for the blocking member in the hammer intersects the pivot pin hole.

8. The firearm according to claim 7, wherein a centerline of the pin bore for the blocking member is offset from a centerline of the pivot pin hole for the hammer pivot pin.

9. The firearm according to claim 7, further comprising a locking clip arranged on a shaft of the hammer pivot pin engaged with a circumferential locking groove formed inside the pivot pin hole in the housing for the hammer, the locking clip operable to resist withdrawal of the hammer pivot pin from the pivot pin hole.

10. The firearm according to claim 9, further comprising a circumferential locking groove formed in the shaft of the hammer pivot pin which is also engaged with the locking clip.

11. The firearm according to claim 2, wherein the hammer pivot pin is non-rotatable relative to the housing.

12. The firearm according to claim 11, wherein the hammer pivot pin includes a transversely elongated cylindrical body and an anti-rotation protrusion extending perpendicularly therefrom which engages a fixation slot in the housing to prevent rotation of the hammer pivot pin.

13. The firearm according to claim 12, further comprising a grip attached to a rear portion of the housing, wherein the grip at least partially overlaps the anti-rotation protrusion to resist withdrawal of the hammer pivot pin from the housing.

14. The firearm according to claim 2, wherein the blocking member is mounted in a lower operating end portion of the hammer opposite an upper striking end portion of the hammer.

15. The firearm according to claim 2, wherein the pin bore includes a smaller diameter section, a larger diameter section slideably receiving a diametrically enlarged retention flange of the blocking member, and a spring acting on the retention flange which biases the blocking member away from the hammer pivot pin.

16. The firearm according to claim 2, wherein the hammer pivot pin is non-rotatable relative to the housing.

17. The firearm according to claim 16, wherein the blocking member is linearly and slideably moveable in the pin bore between a retracted non-blocking position, and a projected blocking position engageable with the blocking feature.

18. The firearm according to claim 17, further comprising a spring biasing the blocking member towards the retracted position.

19. The firearm according to claim 17, wherein the blocking member automatically moves from the retracted position to the projected position when the hammer is in the cocked position which aligns the blocking member with the blocking feature and the firearm is dropped or impacted on a surface.

20. The firearm according to claim 2, wherein the blocking member is not aligned with the blocking feature of the hammer pivot pin when the hammer is in the forward firing position.

21. The firearm according to claim 2, wherein the blocking member is mounted below and movable in an arcuate path about the hammer pivot pin.

22. The firearm according to claim 1, wherein the blocking member blocks full rotational movement of the hammer from the cocked position to firing position when the blocking member engages the blocking feature of the hammer pivot pin such that the firearm cannot be discharged.

23. The firearm according to claim 22, wherein the blocking member when engaged with the blocking feature prevents or retards movement of the hammer from the cocked position such that a firing pin of the firearm cannot be reached or struck with sufficient force by the hammer to discharge the firearm.

24. The firearm according to claim 1, wherein the firearm is a revolver including a rotatable cylinder supported by the housing and defining the at least one cartridge-receiving chamber.

25. The firearm according to claim 1, wherein the blocking member has an anti-friction coating on an exterior surface thereof.

26. The method according to claim 25, wherein the hammer pivot pin is non-rotatable relative to the housing.

27. A firearm with safety mechanism comprising:

a housing;

a spring-biased hammer rotatably supported by a transverse hammer pivot pin fixed in position relative to the housing, the hammer movable between a rearward cocked position and a forward firing position;

a trigger operable to release the hammer from the cocked position to discharge the firearm;

a blocking feature formed on the hammer pivot pin; and a hammer blocking member movably mounted to the hammer and selectively engageable with the blocking feature;

wherein rotating the hammer from the firing position to the cocked position aligns the blocking member with the blocking feature of the hammer pivot pin such that the blocking member is movable to engage the blocking feature;

wherein the blocking member is a cylindrical pin and the blocking feature of the hammer pivot pin is a notch.

28. A method for blocking a firing mechanism of a firearm comprising:

providing the firearm including a hammer mounted about a hammer pivot pin and rotatable between a rearward cocked position and a forward firing position, a trigger operable to release the hammer, and a movable blocking member;

positioning the hammer in the firing position, the blocking member being misaligned with a blocking feature on the hammer pivot pin;

rotating the hammer to the cocked position;

aligning the blocking member with the blocking feature on the hammer pivot pin;

impacting the firearm on a surface;

automatically moving the blocking member from a retracted position disengaged from the blocking feature of the hammer pivot pin to a projected position engaged with the blocking feature; and arresting rotation of the hammer to prevent discharging the firearm via the blocking member engagement with the blocking feature.

29. The method according to claim 28, wherein the blocking member is oriented transversely to the hammer pivot pin.

30. The method according to claim 29, wherein the automatically moving step includes linearly and slideably moving the blocking member between the retracted and projected positions.

31. The method according to claim 28, wherein the blocking member is slideably mounted to the hammer such that rotating the hammer rotates the blocking member in an arcuate path about the hammer pivot pin.

32. The method according to claim 28, wherein the blocking member is oriented between about and including zero and 40 degrees to vertical during the impacting step.

33. The method according to claim 28, further comprising biasing the blocking member towards the retracted position.

34. The method according to claim 28, wherein the blocking feature comprises a flat blocking surface formed on a cylindrical shaft of the hammer pivot pin, the blocking surface engaging a side of the blocking member during the arresting rotation step.

35. The method according to claim 28, wherein the blocking member is mounted in a pin bore of the hammer which intersects a pivot pin hole in which the hammer pivot pin is mounted.

36. The method according to claim 28, wherein the blocking feature is a notch and the blocking member is a pin.

37. A revolver with safety mechanism comprising:

a cylinder frame supporting a rotatable cylinder defining a plurality of cartridge-receiving chambers;

a spring-biased hammer rotatably supported by a stationary hammer pivot pin arranged in the frame, the hammer movable between a rearward cocked position and a forward firing position;

a trigger engageable with the hammer and operable to release the hammer therefrom;

a blocking notch formed on the hammer pivot pin; and a hammer blocking pin movably mounted to the hammer and selectively engageable with the blocking feature;

wherein rotating the hammer from the firing position to the cocked position aligns the blocking pin with the blocking notch of the hammer pivot pin such that the blocking pin is slideably engageable with the blocking notch.

38. The revolver according to claim 37, wherein the blocking member is misaligned with the blocking feature of the hammer pivot pin when the hammer is in the firing position.

* * * * *